US006905418B2

(12) United States Patent
Rhee

(10) Patent No.: US 6,905,418 B2
(45) Date of Patent: Jun. 14, 2005

(54) GOLF SHORT GAME TRAINING, PRACTICE AND CONTEST GAME KIT

(76) Inventor: Yong Su Rhee, 138-26 Yun Hui, 2nd Dong, Seo Dae Mun Ku, Seoul (KR), 120-112

( * ) Notice: Subject to any disclaimer, the term of this patent is extended or adjusted under 35 U.S.C. 154(b) by 0 days.

(21) Appl. No.: 10/322,436

(22) Filed: Dec. 19, 2002

(65) Prior Publication Data

US 2003/0125121 A1 Jul. 3, 2003

(30) Foreign Application Priority Data

Dec. 27, 2001 (KR) ..... 10-2001-0086448

(51) Int. Cl.[7] ..... A63B 69/36
(52) U.S. Cl. ..... 473/197; 473/172
(58) Field of Search ..... 473/100–156, 473/168–170, 172, 190–197; 273/398–402

(56) References Cited

U.S. PATENT DOCUMENTS

| | | | | | |
|---|---|---|---|---|---|
| 920,907 | A | * | 5/1909 | Bolton | 473/197 |
| 1,262,314 | A | * | 4/1918 | Downey | 273/352 |
| 1,540,670 | A | | 6/1925 | Vidmer | |
| 1,543,401 | A | | 6/1925 | Steinmetz | |
| 1,545,772 | A | * | 7/1925 | Jacobs | 473/190 |
| 1,677,442 | A | | 4/1928 | Hall | |
| 1,788,803 | A | * | 1/1931 | MacGeorge | 473/157 |
| 1,927,741 | A | * | 9/1933 | Herbert | 473/191 |
| 1,989,542 | A | | 1/1935 | Boothman | |
| 2,123,195 | A | * | 7/1938 | Middleton | 473/137 |
| 2,899,208 | A | * | 8/1959 | Wallsteiner | 473/194 |
| 3,260,527 | A | * | 7/1966 | Younce | 473/166 |
| 3,328,033 | A | * | 6/1967 | Hendry | 473/184 |
| 3,594,006 | A | * | 7/1971 | Clatt | 473/154 |
| 4,395,042 | A | * | 7/1983 | Boswell | 473/195 |
| 4,556,219 | A | | 12/1985 | Tillery | |
| 4,723,780 | A | * | 2/1988 | Vinzetta | 473/197 |
| 4,905,996 | A | * | 3/1990 | Tallent et al. | 473/197 |
| 4,948,141 | A | | 8/1990 | Newman | |
| 5,018,731 | A | | 5/1991 | Doyle | |
| 5,037,095 | A | * | 8/1991 | Nedwick | 473/439 |
| 5,492,319 | A | | 2/1996 | Lee | |
| 5,580,320 | A | * | 12/1996 | Meikle | 473/197 |
| 5,947,831 | A | * | 9/1999 | McCarthy | 473/197 |
| 6,264,570 | B1 | * | 7/2001 | Yoon | 473/197 |
| 6,485,373 | B1 | * | 11/2002 | Stephens | 473/197 |

FOREIGN PATENT DOCUMENTS

WO WO 97/12649 10/1995

OTHER PUBLICATIONS

European Search Report from applicant's corresponding European patent application.

* cited by examiner

*Primary Examiner*—Mark S. Graham
(74) *Attorney, Agent, or Firm*—Fisher Christen & Sabol

(57) ABSTRACT

A Golf Short Game Training, Practice and Contest Game assemblage, which is easy to assemble, disassemble and transport from location to location (in, for example, the provided carrying bag) and which includes a main frame which is assembled from various steel pipes and connecting parts, a netting which is supported by the frame and which includes an inclined chute-shaped floor net which is affixed to or integral with the bottom floor of the netting, the front side of which is lower than the back portion of the netting; and a target which is suspended from the top portion of the netting and has at least one hole in it which is larger than a golf ball.

20 Claims, 22 Drawing Sheets

GOLF SHORT GAME TRAINING, PRACTICE AND CONTEST GAME KIT

BACKGROUND OF THE INVENTION

1. Field of the Invention

This invention relates to a golf training, practice and contest game kit and, in particular, to a golf game kit which is easily assembled and disassembled, is conveniently portable in a provided carrying bag, requires little space both when it is assembled and when it is disassembled, and which, among other features, has a dropped ball flow and directional control mechanism with which one or more balls can be conveniently gathered or returned automatically to the player.

2. Description of Related Art

Other golf game training kits exist in which a player hits one or more balls against a back net with a simple target a short distance from the player. However, the subject golf game training kit does not include only one simple target a short distance away from the player. Rather, it includes a holed target with at least one (perhaps numbered) hole into which the player can hit the ball and/or a plain target with solid, colored circles on it.

Other golf game kits require considerable space in which they may be assembled and/or played with. The subject invention can be used in areas of limited space, such as, in indoor rooms, gardens and roof tops. The design of the inclined floor net and the front flaps which flare outward prevent ball(s) from rolling beyond the allotted space/area. Other golf game training kits may require a wider allotted area, as the balls will scatter without a dropped ball flow control mechanism (which the subject invention has).

With regard to the subject invention, when a player hits a ball through one of the target holes, thereafter it will be caught in an attached mesh pouch. Then, the player can step forward, unzip the zipper on the back right side of the netting, reach in and release the ball from the mesh pouch. Thereafter, the ball will fall to the bottom floor of the netting, roll forward to the inclined floor net and, then, roll out onto the chipping green, for example, and back to the player, unless a pocket has been formed by the player in the inclined floor net into which one or more balls will be caught/gathered. When a player hits a ball against one of the solid colored, circular, plain targets, thereafter it will fall to the bottom floor of the netting, roll forward to the inclined floor net and, then, roll out onto the chipping green, for example, and back to the player, unless a pocket has been formed by the player in the inclined floor net into which one or more balls will be caught/gathered.

With regard to the subject invention, therefore, the player can play with just one ball which will be (1) automatically returned to him/her, (2) caught in a pocket in the netting (for easy pick-up/collection), or (3) caught in a mesh pouch behind a target hole (for the player to easily release, at which point it will automatically roll back to the chipping green, for example). Other golf game training kits lacking a dropped ball flow control mechanism may require, in practical terms, the use of more than one golf ball.

Finally, the subject invention is particularly easy to assemble, disassemble and transport from location to location (in, for example, the provided carrying bag).

BROAD DESCRIPTION OF THE INVENTION

An object of the invention is to have a golf short game training, practice and contest game kit which is easy to assemble, disassemble and transport from location to location (in, for example, the provided carrying bag). One person is able to easily transport the subject kit in its provided carrying bag.

Another object of the invention is to have an efficient, effective and economical short game shot training kit.

Another object of the invention is to have a short game shot training kit which can help a player improve the accuracy of his/her shot in terms of direction, height and distance, in general. In particular, since the target panel may include, for example, five different vertically hanging targets, this acts as a guide for a player trying to make a shot at a certain angle. This allows for a player to efficiently and effectively practice his/her approaching shots near the green, for example.

Another object of the invention is to have a golf short game training, practice and contest game kit which is fun for the player(s) to use, as for example, as an amusement contest game tool, and which may reduce the workplace and other stress levels of the player(s).

Another object of the invention is to have a golf contest game kit which one or more players can use in a competitive manner, perhaps by keeping score. When the target panel(s) used have numbers on them adjacent to the individual targets, the player(s) can add together the numbers corresponding with the targets their shots hit or enter through. The subject kit may be used as a contest game tool at, for example, a resort.

Another object of the invention is to have a golf short game training, practice and contest game kit which allows the player to save time and money by being able to practice his/her short game at home instead of having to drive to and pay the fees of, for example, a country club or driving range.

Another object of the invention is to have a golf short game training, practice and contest game kit which is not weather dependent. For example, on a cold, rainy or snowy day, the kit can be easily transported to and assembled in a warm or dry location.

Another object of the invention is to have a golf short game training, practice and contest game kit which can be used in areas of limited space, such as, in indoor rooms, gardens, and roof tops.

Another object of the invention is to have a golf short game training, practice and contest game kit, the design of which prevents ball(s) from scattering and rolling beyond the allotted space/area.

Another object of the invention is to have a golf short game training, practice and contest game kit, the design of which allows the player to collect/gather the balls in a pocket in the front of the netting.

Another object of the invention is to have a golf short game training, practice and contest game kit, the design of which allows the player to use just one ball which will be (1) automatically returned to him/her, (2) caught in a pocket in the netting (for easy pick-up/collection), or (3) caught in a mesh pouch behind a target hole (for the player to easily release, at which point it will automatically roll back to the chipping green, for example).

Another object of the invention when the plain target panel (with at least one solid colored circle imprinted or attached onto it) is used is to allow for rapid, repeating practice of shots by a player. This is possible because the ball will fall onto the bottom floor of the netting after hitting the target, then quickly roll onto and down the inclined floor net onto the chipping green (for example) and back to the player.

Other objects and advantages of the invention are set out herein or are obvious herefrom to one skilled in the art.

The objects and advantages of the invention are achieved by the Golf Short Game Training, Practice and Contest Game Kit of the invention.

The invention includes the following, in whole or part:

1) a main frame which is assembled from various steel pipes and connecting parts (which are either permanently attached to one another by means of, for example, screws, or are manually connected to one another as the frame is assembled);
2) a netting which is hung over and from the main frame, and which is held in place with, for example, clips (which are permanently attached to the netting and which may be secured on to and later removed from the various steel pipes and connecting parts), and which includes, among other features, (a) two front flaps which flare outwards from the front opening of the frame and, thereby, help to channel golf balls into the structure as they are shot, and (2) an inclined and bendable/moldable floor net which can form a pocket into which one or more balls will be caught/gathered or may be bent/inclined so that a ball which falls into the bottom floor net will roll forward into the inclined floor net and, then, roll out onto the chipping green, for example, and back to the player;
3) at least one target back panel or safety net which is secured either to top, back side bars of the frame or to elastic rings which are attached to a band which runs across and is attached to the top of the netting;
4) one or more target panels which may be positioned beside one another or with one in front of the other, each target panel being removably or permanently attached to either a target back panel or safety net, and each target panel having at least one (perhaps numbered) solid colored target or holed target (with a mesh pouch behind the hole to catch the ball when it is shot through the hole);
5) two small bags in which a heavy material, such as sand, clean kitty litter or pebbles, can be put, and which can be placed on the two front flared flaps of the netting to hold them down and in position;
6) a chipping green into which a golf ball may fall from the inclined floor net and automatically roll back to a waiting player;
7) a putting green;
8) a rectangular material which may be positioned beneath the chipping green so that, as a player stands alongside of the chipping green shooting a ball into the front of the frame with netting, he/she stands on the rectangular material;
9) directions for how to easily and quickly assemble the frame; and
10) a score card with instructions/rules for how to play the so-called Jason Golf Game. The Jason Golf Game Rules are as follows:

(1) The Jason Golf Game consists of a total of 18 holes, 9 out and 9 in. The winner is decided by the total score of each hole.

(2) The score for each hole is decided by adding together the numbers assigned to the holes into which the ball was shot. (The assigned number may be printed adjacent to, above or below the corresponding target hole. Per each hole, four shots will be made. For example, if two of four balls are shot into the number four hole and the number two hole and the other two balls miss the holes, the total score for this hole will be six, that is, four plus two.

(3) If the ball is shot outside of the installed net, it becomes OB (out of bounds) with a two score penalty.

(4) If the club touches the ball before a shot is made, it will be counted as a shot made.

(5) The shot should be made at the tee mat. If the shot is not made at the designated tee mat position, there will be a penalty of one stroke.

(6) A ball that goes into a hole may be removed before another shot is made, or the next shot may be made while the previous ball remains in the hole.

Modifications and changes made to this Golf Short Game Training, Practice and Contest Game Kit can be effected without departing from the scope or spirit of the present invention. For example, the dimensions (height, width, depth) of the game kit can be altered without departing from the scope or spirit of the present invention. Also, the embodiments of this game kit which are illustrated as follows have been shown only by way of example and should not be taken to limit the scope of the following claims.

LIST OF PARTS NUMBERS

Figure 1:
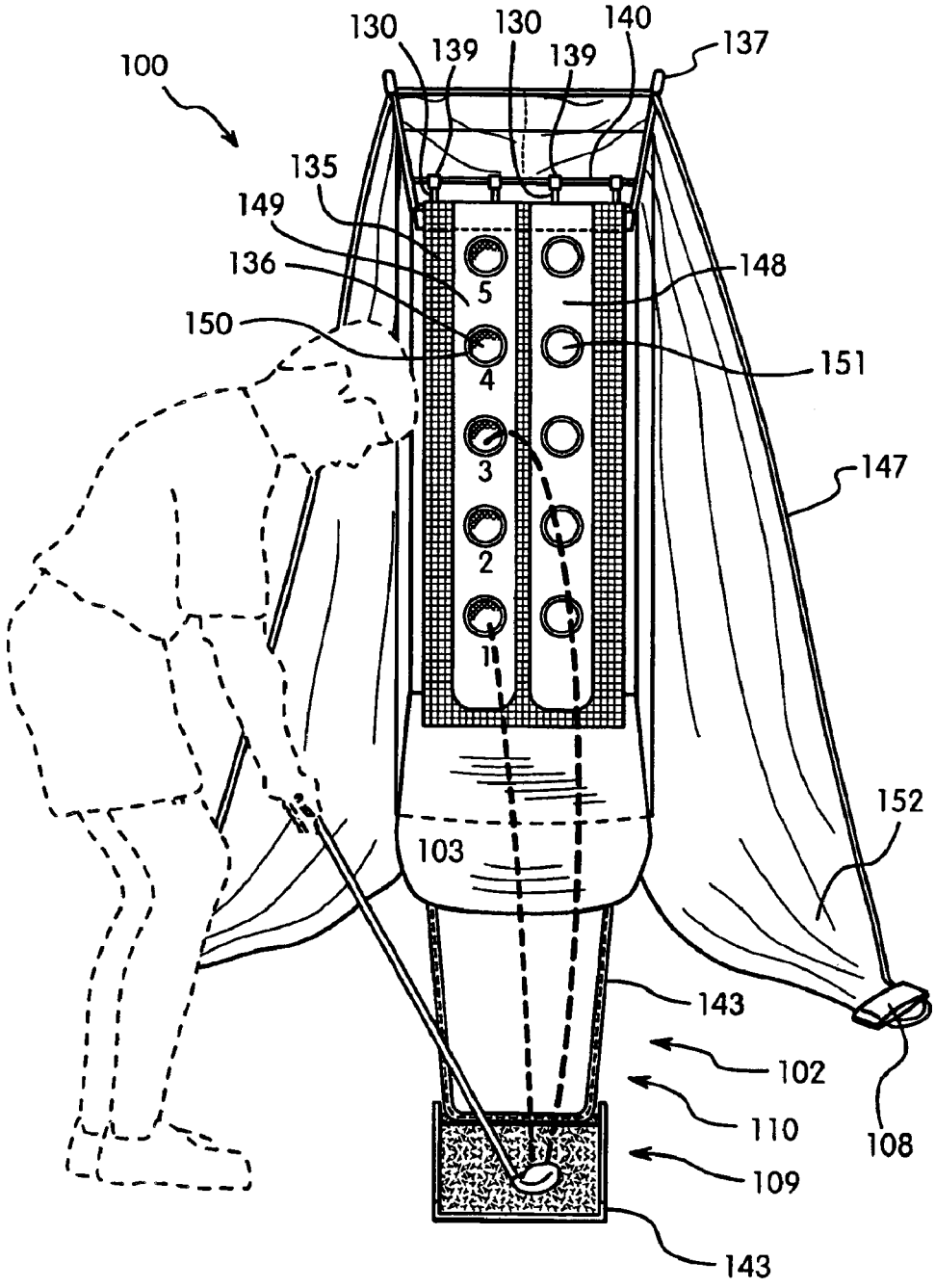
FIG. 1 is a perspective view of the Golf Short Game Training, Practice and Contest Game Kit (minus the putting green and the rectangular green) with a player positioned beside the chipping green, in front of the frame (first embodiment)
Figure 2:
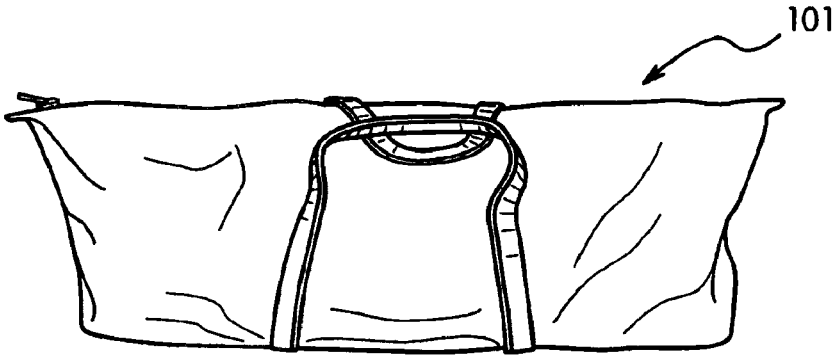
FIG. 2 is a side view of the carrying bag with the Golf Short Game Training, Practice and Contest Game Kit in it (first embodiment)
Figure 3:
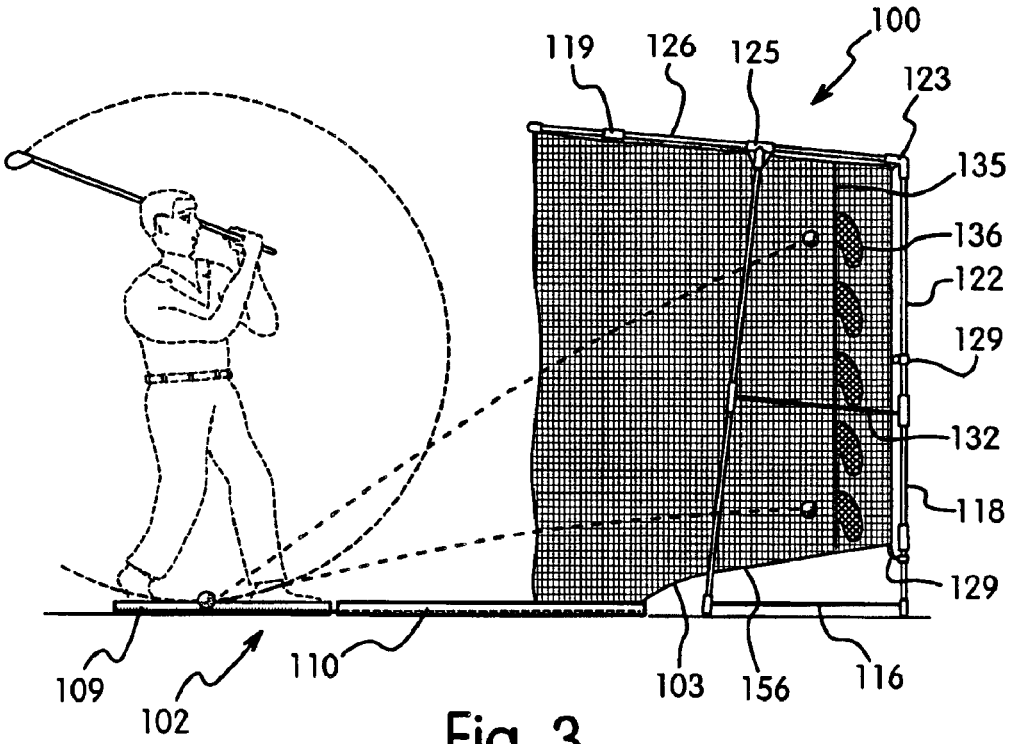
FIG. 3 is a side view of a player standing beside the chipping green, hitting a ball into two of the holed targets with attached mesh pouches (first embodiment)

In connection with the figures, the following list of the names of the parts instant invention are noted:

100 Short Game Kit (first embodiment) minus the putting green (106) and the rectangular green (107)
101 carrying bag
102 chipping green
103 inclined floor net (first embodiment)
104 netting (entire) of first embodiment
105 frame (entire) of first embodiment
106 putting green
107 rectangular green
108 bag
109 first portion of chipping green
110 second portion of chipping green
111 score card
112 cup
113 raised mound
114 front and back bottom horizontal pipes (first embodiment)
115 plastic connecting part (first embodiment)
116 bottom connecting bar (first embodiment)
117 back middle horizontal pole (first embodiment)
118 back bottom vertical pole (first embodiment)
119 plastic connecting part (first embodiment)
120 plastic connecting part (first embodiment)
121 front bottom vertical pole (first embodiment)
122 front top vertical pole (first embodiment)
123 plastic connecting part (first embodiment)
124 top back horizontal pole (first embodiment)
125 plastic connecting part (first embodiment)
126 top front horizontal bar (first embodiment)
127 plastic end knob (first embodiment)
128 top front horizontal pole (first embodiment)
129 clip (first embodiment)
130 hook (first embodiment)
132 middle connecting bar (first embodiment)
133 top back horizontal bar (first embodiment)
134 zipper (first embodiment)
135 target back panel (first embodiment)
136 mesh pouch (first embodiment)
137 tubular portion of netting (first embodiment)
138 wire (first embodiment)
139 elastic ring (first embodiment)
140 band across and attached to netting to which elastic rings (139) are attached (first embodiment)
141 synthetic grass in first portion of chipping green
142 material surface in second portion of chipping green
143 raised plastic edge of chipping green
144 cap at end of raised plastic edge of chipping green
145 overhanging flap with Velcro™ strip (hooks) of second portion of putting green

146 Velcro™ strip (loops) at end of first portion of putting green
147 material strip attached to netting
148 plain target panel
149 holed target panel
150 solid colored circle around target hole (first embodiment)
151 solid colored target (first embodiment)
152 front flaps of the netting (first embodiment)
153 back portion of the netting (first embodiment)
154 top portion of the netting (first embodiment)
155 side portion of the netting (first embodiment)
156 bottom floor of the netting (first embodiment)
157 back top vertical pole
200 frame (entire) of second embodiment
201 netting (entire) of second embodiment
202 inclined floor net (second embodiment)
203 safety net (second embodiment)
204 plain target panel (second embodiment)
205 holed target panel (second embodiment)
206 mesh pouch (second embodiment)
207 clip (second embodiment)
208 Velcro™ strip on square safety net (second embodiment)
209 Velcro™ strip on target panel (second embodiment)
210 plain individual mark (second embodiment)
211 holed individual mark (second embodiment)
212 mesh pouch (second embodiment)
213 zipper (second embodiment)
214 plastic connecting part (second embodiment)
215 plastic connecting part (second embodiment)
216 plastic connecting part (second embodiment)
217 hole in connecting part 216 (second embodiment)
218 plastic connecting part (second embodiment)
219 hole in connecting part 218 (second embodiment)
220 rod (second embodiment)
221 front top sleeve of the netting (second embodiment)
222 front flaps of the netting (second embodiment)
223 back portion of the netting (second embodiment)
224 top portion of the netting (second embodiment)
225 side portion of the netting (second embodiment)
226 wire (second embodiment)
227 material strip attached to the netting (second embodiment)
228 top back horizontal pipe (second embodiment)
229 plastic connecting part (second embodiment)
230 bottom pipe (second embodiment)
231 top middle horizontal pipe (second embodiment)
232 back middle horizontal pipe (second embodiment)
233 front top vertical pole (second embodiment)
234 front bottom vertical pole (second embodiment)
235 back top vertical pole (second embodiment)
236 back bottom vertical pole (second embodiment)
237 hook attached to the netting
238 bar
239 clip
240 bottom floor of the netting (second embodiment)
241 flat or bendable surface (second embodiment)
242 top back horizontal bar (second embodiment)
243 top middle horizontal bar (second embodiment)
244 top front horizontal bar (second embodiment)
245 zipper on bag (108)

DETAILED DESCRIPTION OF THE INVENTION

As shown in the accompanying drawings, FIGS. 1 to 51, the Golf Short Game Training, Practice and Contest Game Kit includes a chipping green (102), a putting green (106), a rectangular green (107), and a carrying bag (101).

Figure 33:
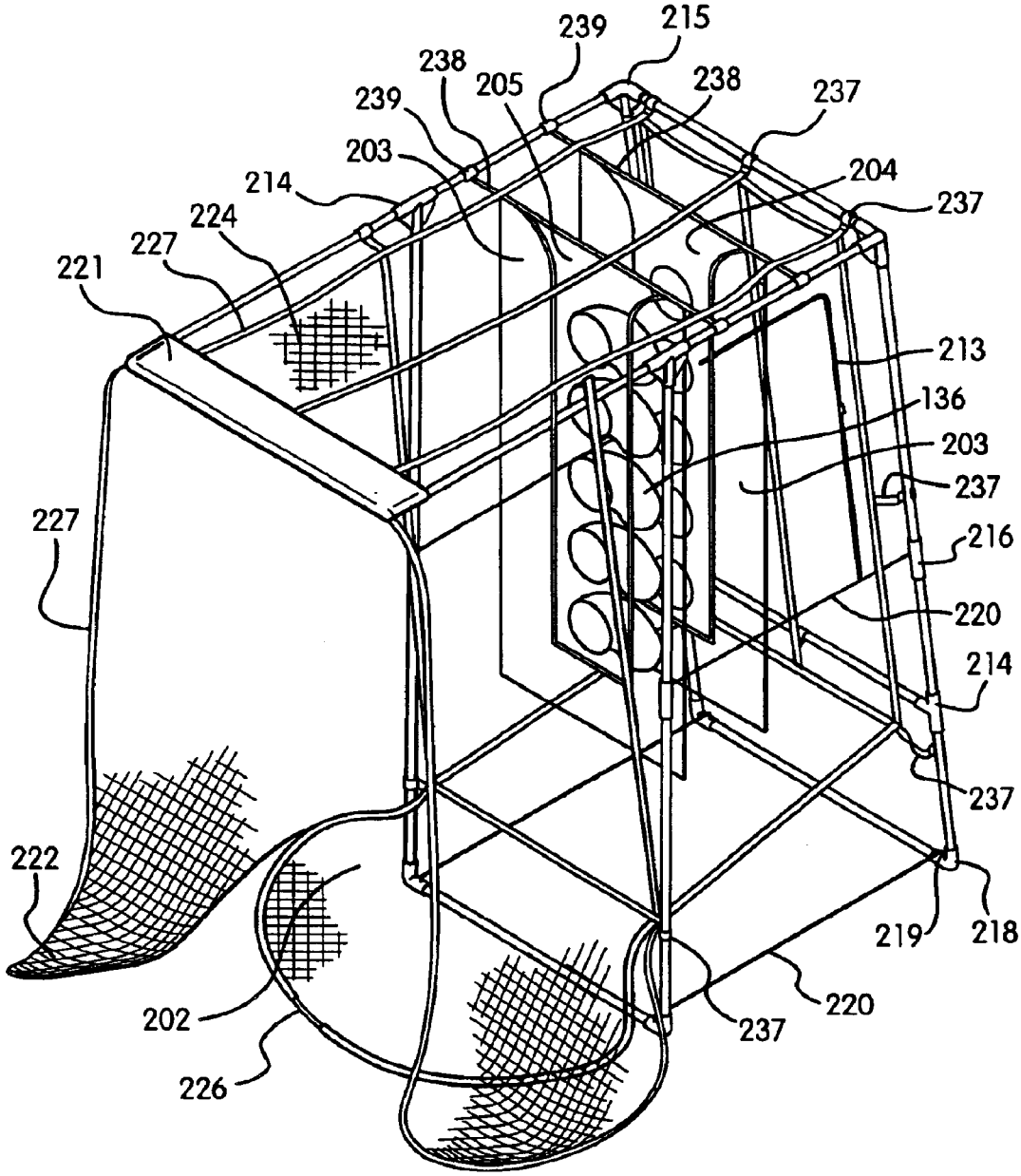
FIG. 33 is a side perspective, elevated view of the netting and both a safety net with an attached plain target panel and a safety net with an attached holed target panel (second embodiment)
Figure 34:
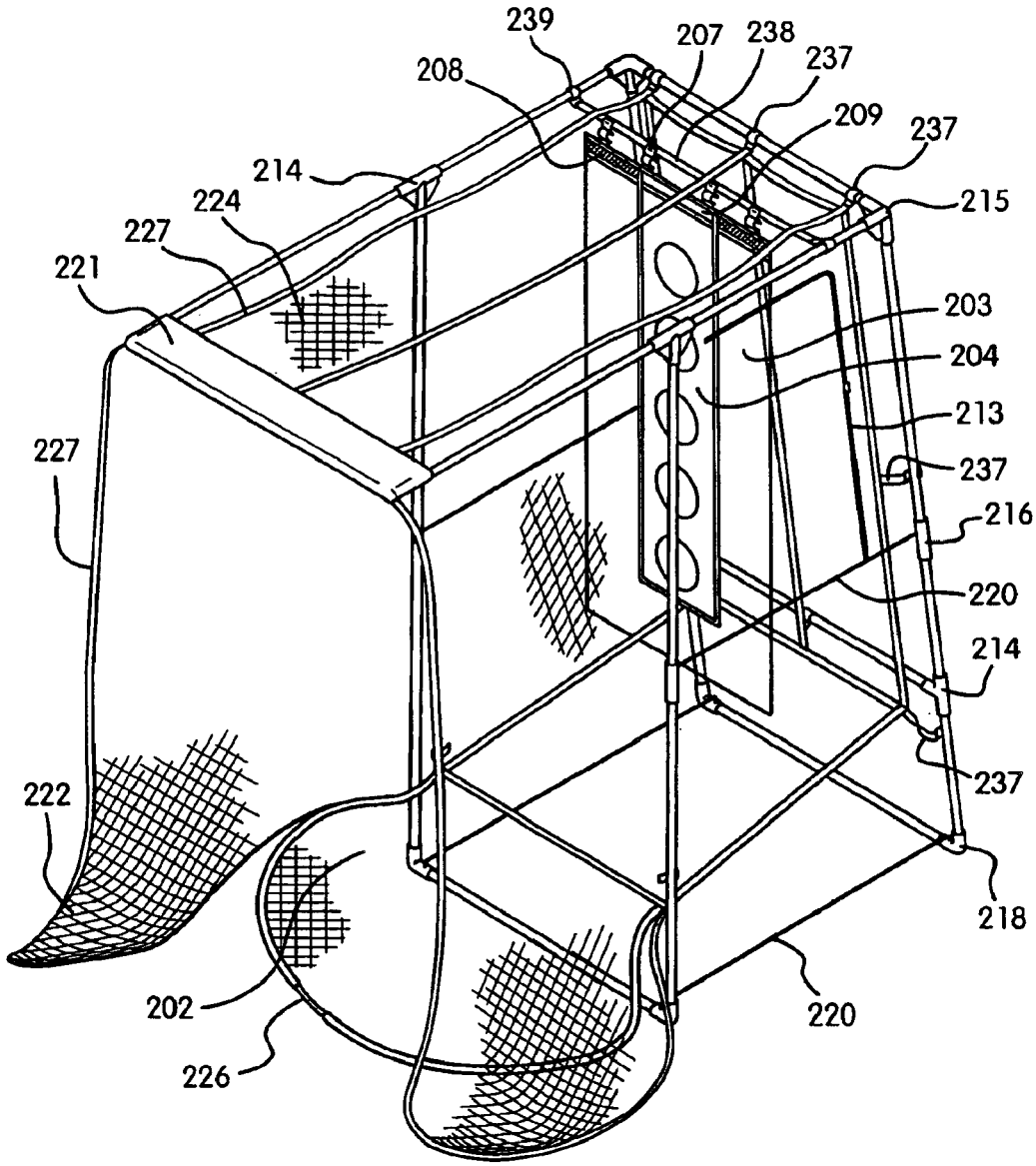
FIG. 34 is a side perspective, elevated view of the netting and a safety net with an attached plain target panel (second embodiment)
Figure 35:
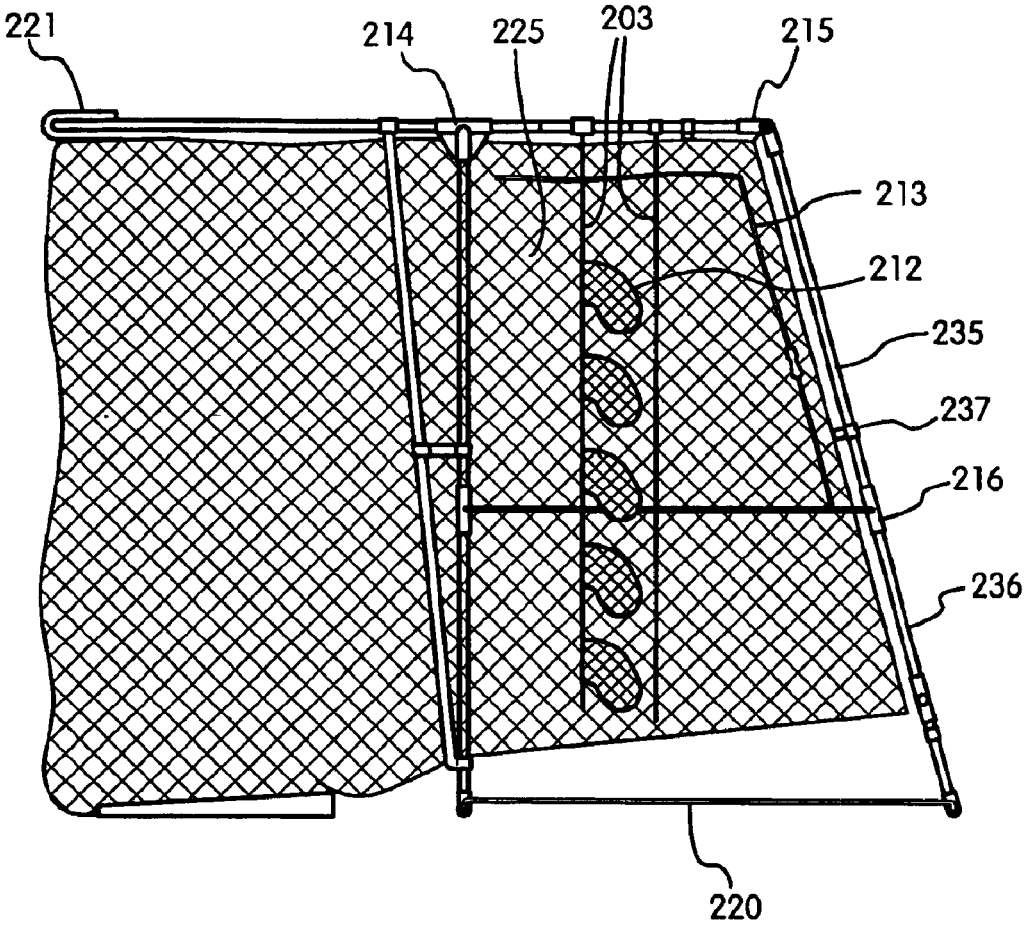
FIG. 35 is a side view of the frame, netting and holed target panel with attached mesh pouches (second embodiment)
Figure 36:
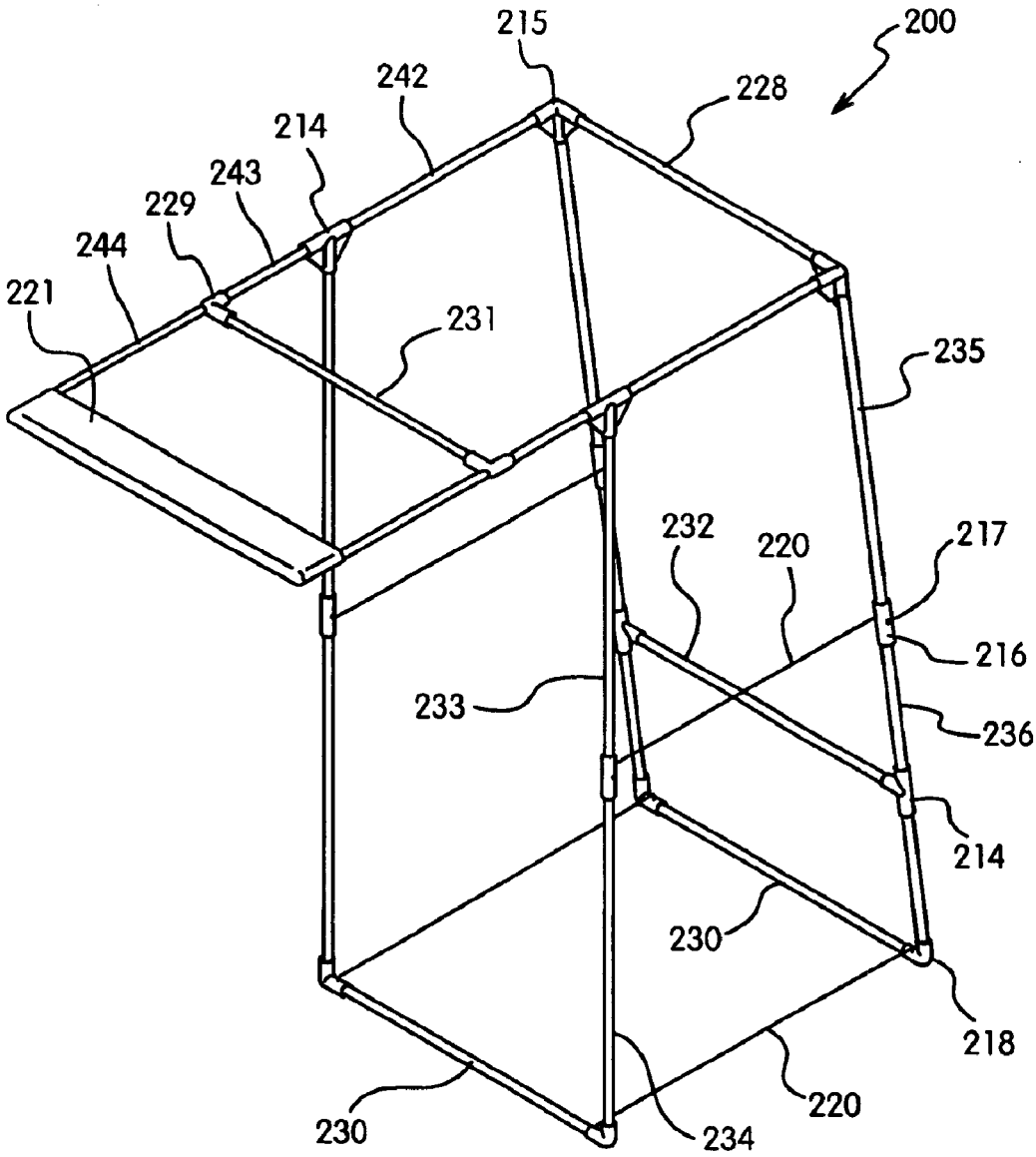
FIG. 36 is a side perspective, elevated view of the entire assembled frame (second embodiment)
Figure 37:
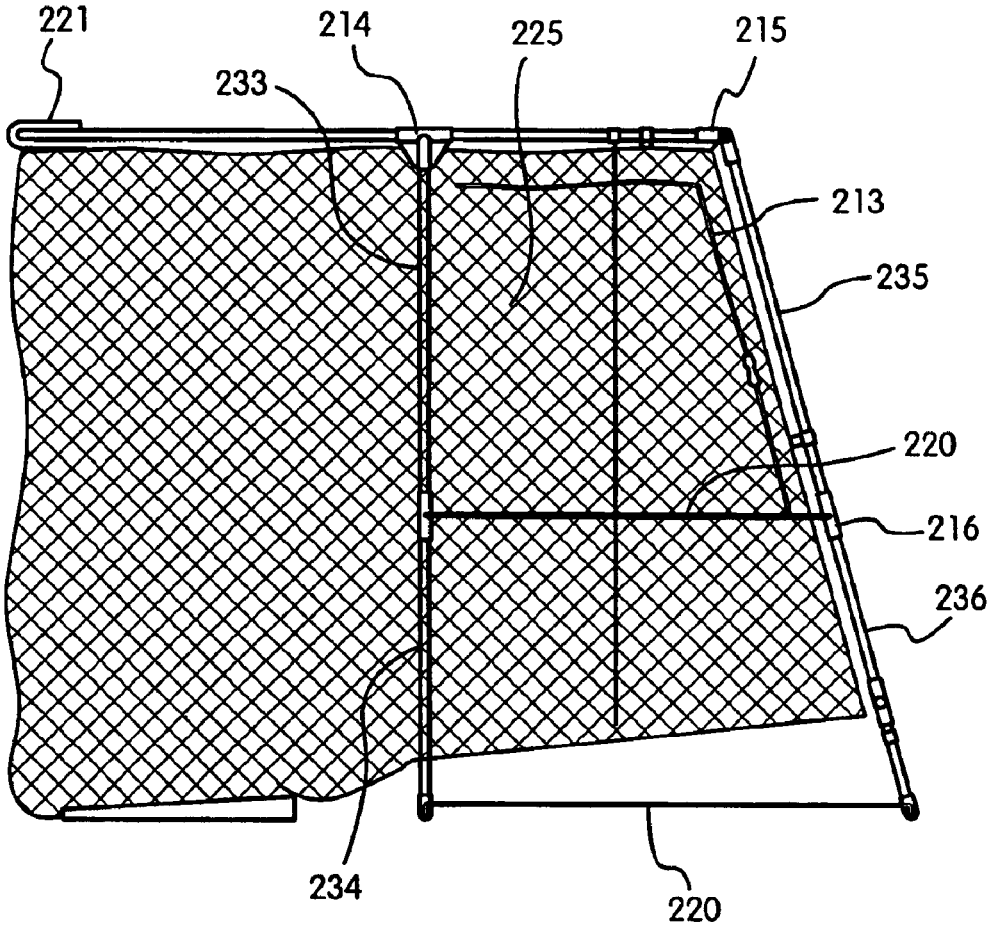
FIG. 37 is a side view of the frame and netting including a hanging safety net (second embodiment)
Figure 38:
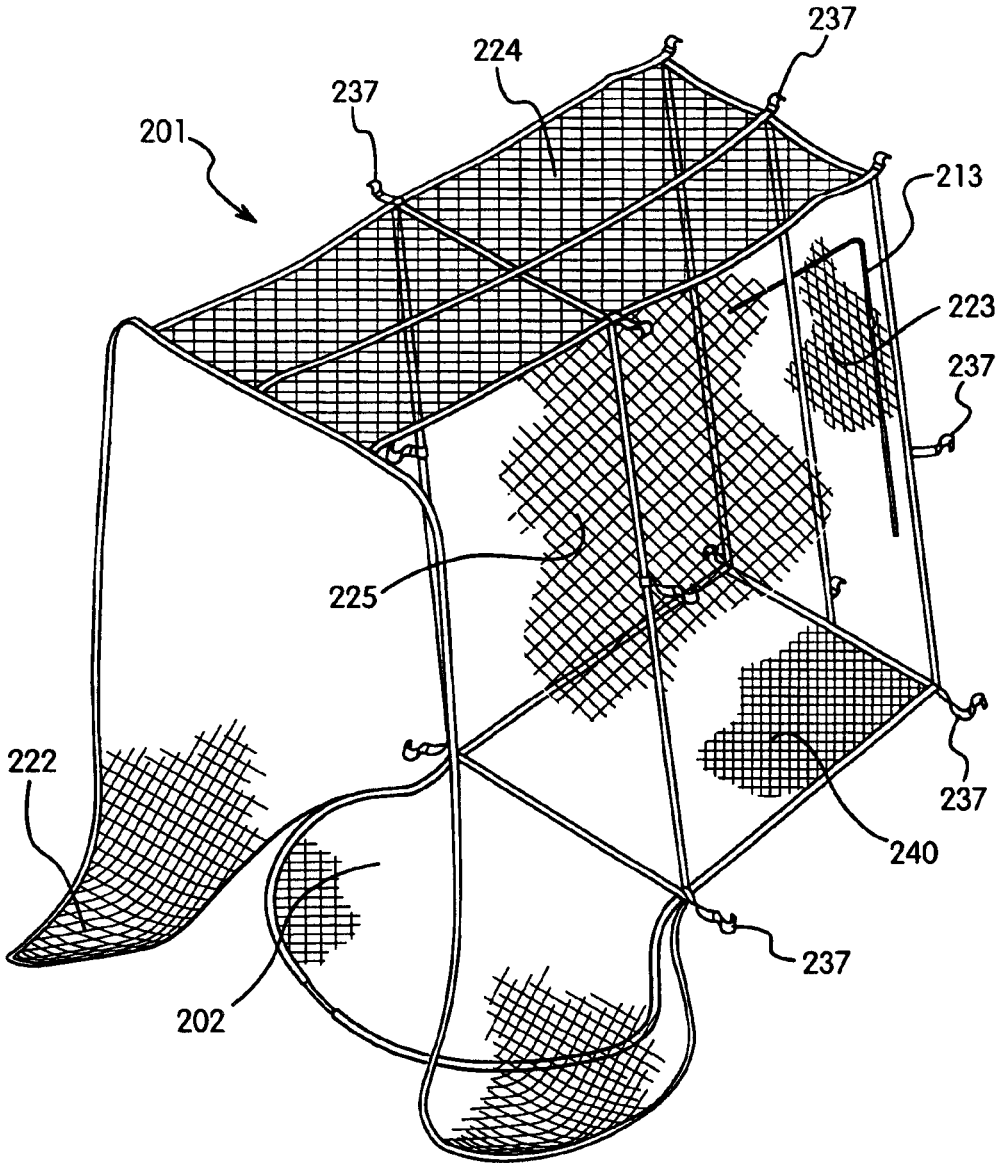
FIG. 38 is a side perspective, elevated view of the netting (second embodiment)
Figure 39:
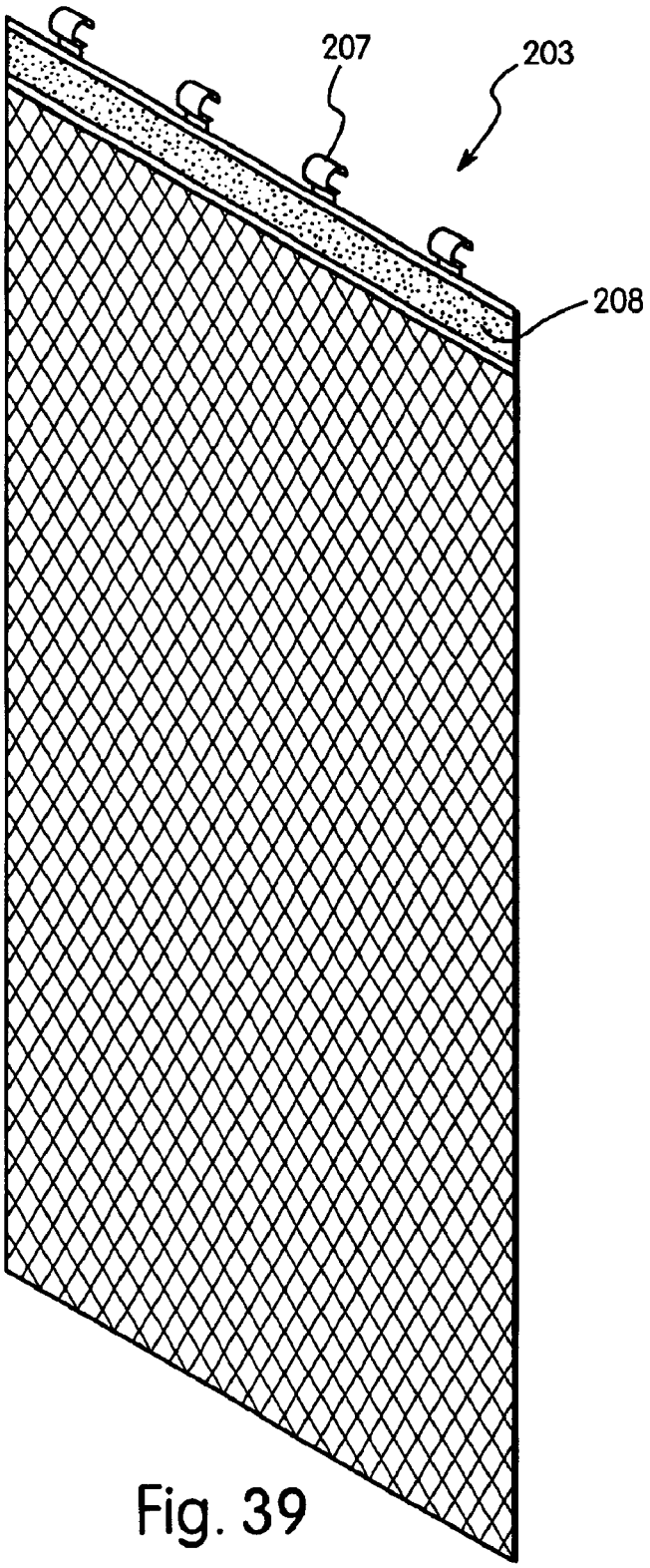
FIG. 39 is a perspective view of the safety net (second embodiment)
Figure 40:
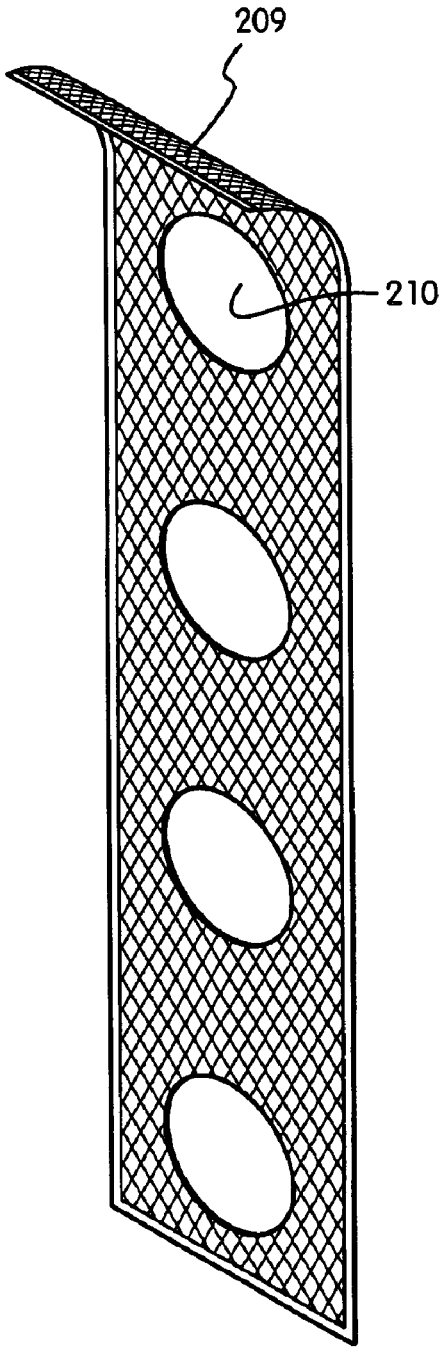
FIG. 40 is a perspective view of the plain target panel (second embodiment)
Figure 41:
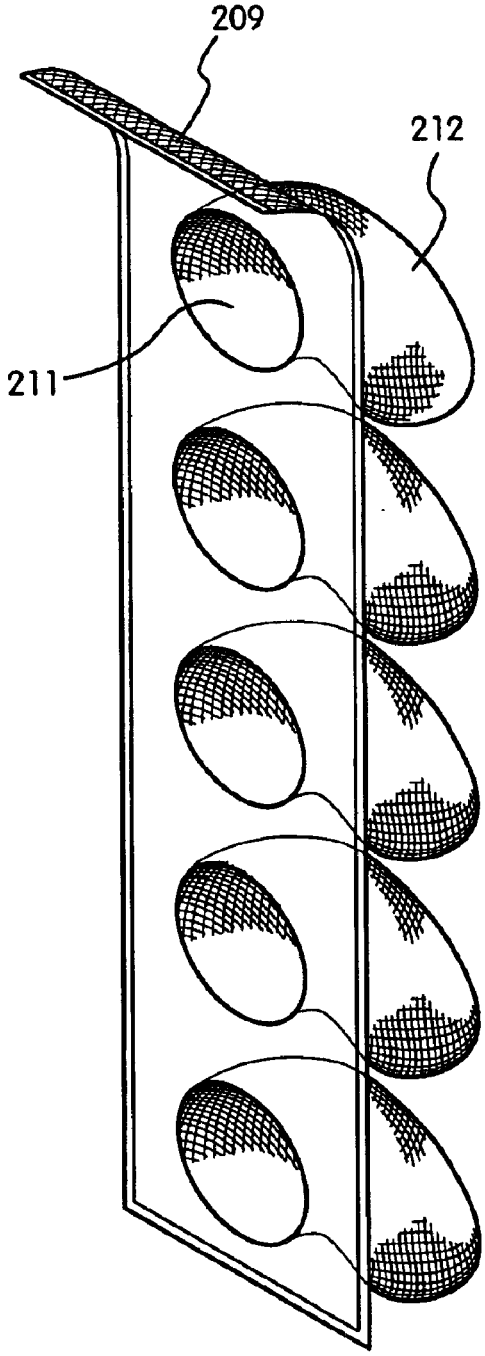
FIG. 41 is a perspective view of the holed target panel (second embodiment)
Figure 42:
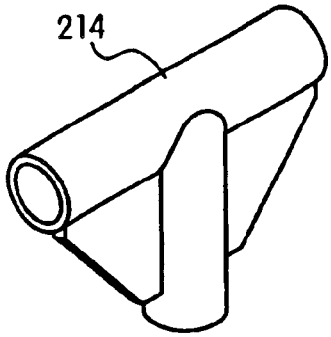
FIG. 42 is an is a view of a plastic connecting part (second embodiment)
Figure 43:
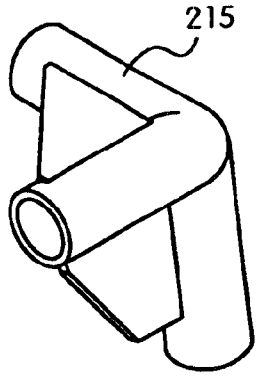
FIG. 43 is a view of a plastic connecting part (second embodiment)
Figure 45:
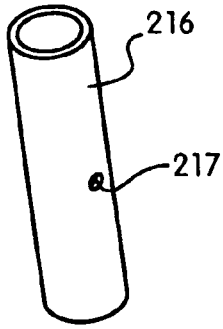
FIG. 45 is a view of a plastic connecting part (second embodiment)
Figure 44:
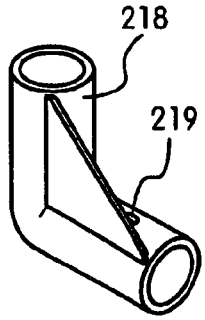
FIG. 44 is a view of a plastic connecting part (second embodiment)
Figure 46:
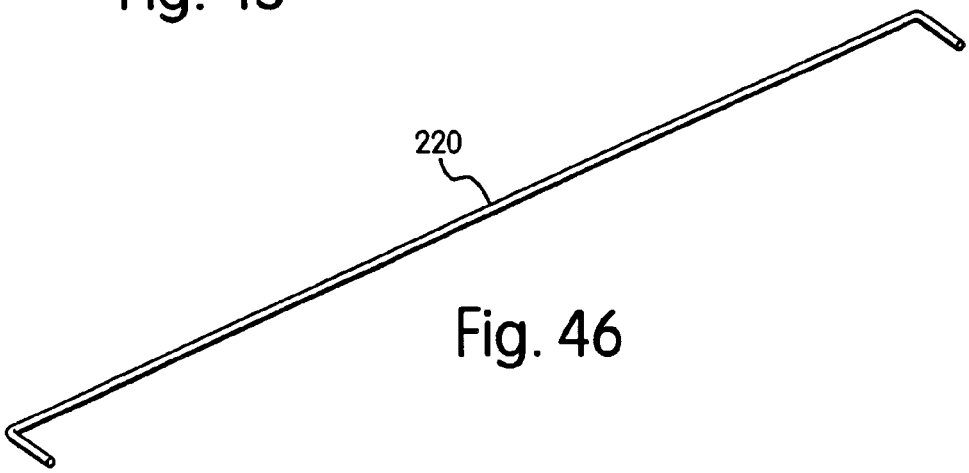
FIG. 46 is a view of a rod (second embodiment)
Figure 47:
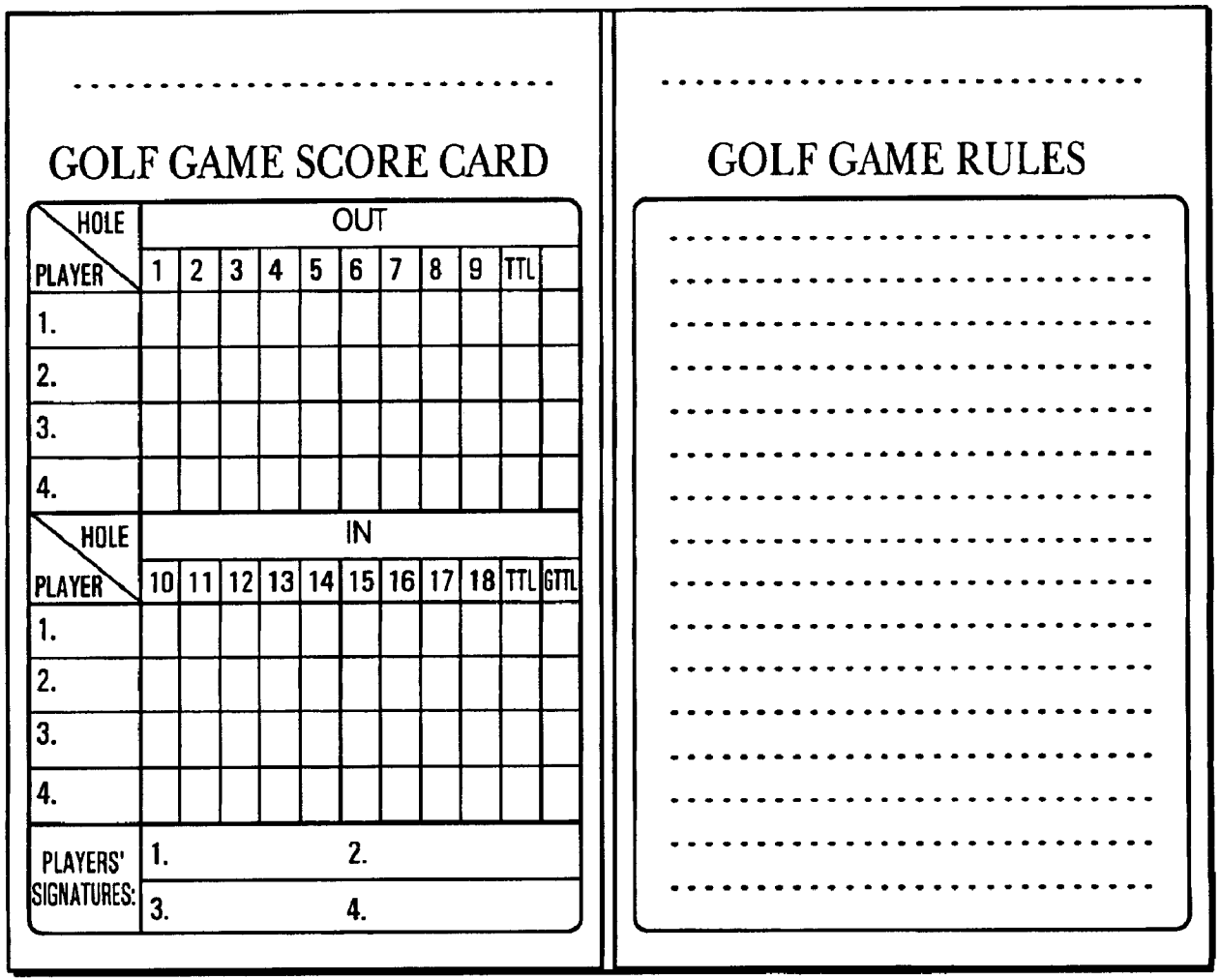
FIG. 47 is a view of the Golf Game Score Card which may be included as part of the Golf Short Game Training, Practice and Contest Game Kit.
Figure 48:
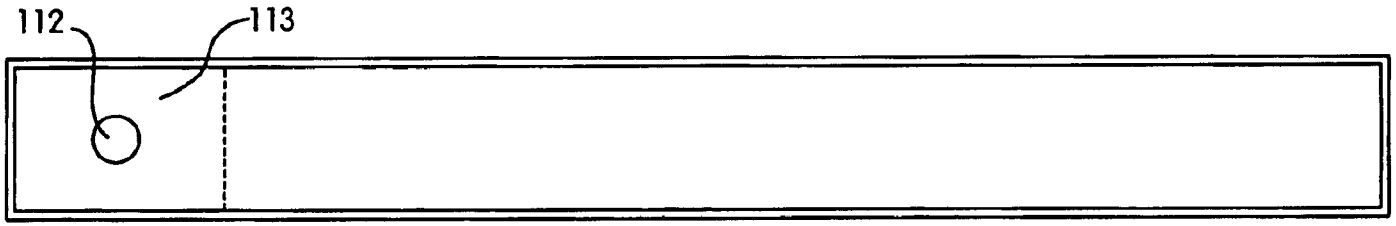
FIG. 48 is a top view of the putting green which may be included as part of the Golf Short Game Training, Practice and Contest Game Kit.
Figure 49:
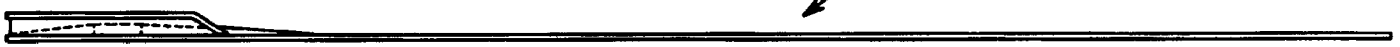
FIG. 49 is a side view of the putting green which may be included as part of the Golf Short Game Training, Practice and Contest Game Kit.
Figure 50:
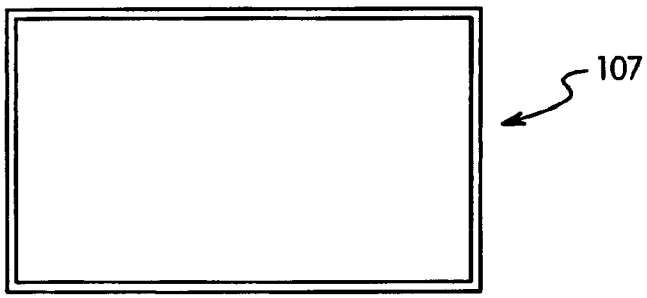
FIG. 50 is a top view of the rectangular green which may be included as part of the Golf Short Game Training, Practice and Contest Game Kit.
Figure 52:
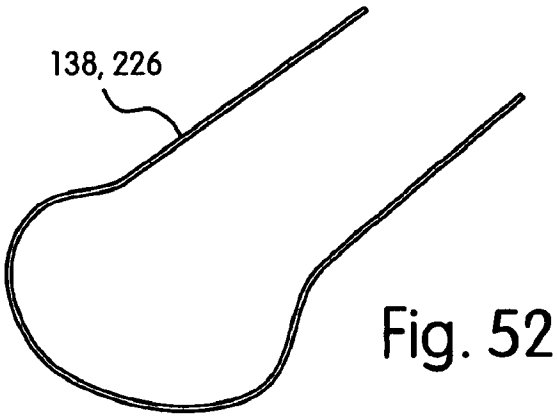
FIG. 52 is a side perspective, elevated view of the wire which is attached to the outer edge of the inclined floor net (first and second embodiments).

At least two embodiments of the Golf Short Game Training, Practice and Contest Game Kit are shown and described in this application. For example, FIGS. 1, 5, 6 and 31 illustrate at least part of what is herein referred to as the "first embodiment" of the Golf Short Game Training, Practice and Contest Game Kit. Also, for example, FIGS. 33, 34 and 36 illustrate what is herein referred to as the "second embodiment" of the Golf Short Game Training, Practice and Contest Game Kit.

The dimensions of the (entire) frame of the first embodiment (105) are 27 inches (70 cm) by 74.5 inches (190 cm) by 78.6 inches (200 cm) (width by length by height). The dimensions of the framework are preferably such that the Golf Short Game Training, Practice and Contest Game Kit will fit easily in a room in a residence including an apartment, or an office, or a business or non-business, recreational, exercise, etc., facility.

The frame of both embodiments is assembled with various steel pipes and bars and plastic connecting parts. However, the various pipes and bars need not be made of steel. Instead, they can be made of a different type of metal, or even a strong, non-metallic material. Similarly, the plastic connecting parts need not be made of plastic. Instead, they can be made of any strong material.

Directions for how to assemble the frame (105) may be provided as part of the Golf Short Game Training, Practice and Contest Game Kit. To assemble the frame (105) of the first embodiment, the following steps may be followed. This elaboration of suggested assembly steps also serves to illustrate how the various steel pipes and bars and plastic connecting parts of the first embodiment are connected to and located in relation to one another.

Figure 32A:
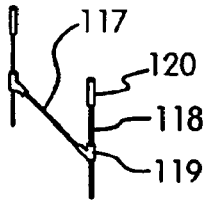
FIGS. 32*a–h* are side perspective, elevated views of the frame in progressive stages of being assembled.
Figure 32B:
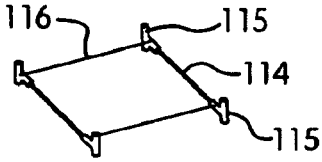

1.) Connecting part (115) is attached to either side of both a front bottom horizontal pipe (114) and a back bottom horizontal pipe (114). Each of the two hooked ends of bottom connecting bar (116) are put into a hole in connecting part (115). In this manner, the square structure shown in FIG. 32*b* is formed.

2.) Attached to one end of each of two back bottom vertical poles (118) is plastic connecting part (120). Each of the two bottom vertical poles runs through plastic connecting part (119). Plastic connecting part (119) is secured in place on each of the two back bottom vertical poles (118). Each end of back middle horizontal pole (117) is put into connecting part (119), securing each end of back middle horizontal pole (117) to a back bottom vertical pole (118). This is shown in FIG. 32*a*.

Figure 32C:
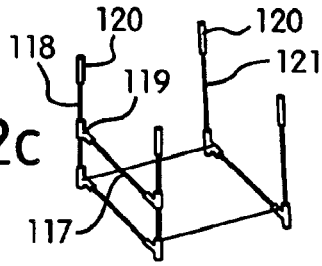

3.) The end of each of two back bottom vertical poles (118) which is not attached to connecting part (120) is placed into one of the two connecting parts (115) attached to the ends of the back bottom horizontal pipe (114). The end of each of two front bottom vertical poles (121) which is not attached to plastic connecting part (120) is placed into one of the two connecting parts (115) attached to the ends of the front bottom horizontal pipe (114). This is shown in FIG. 32*c*.

Figure 32D:
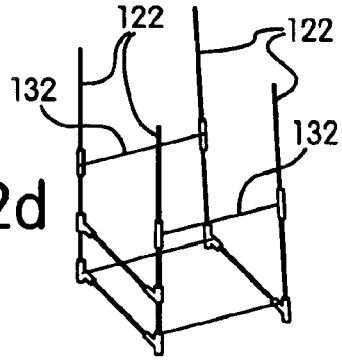

4.) A front top vertical pole (122) is placed into each of the four connecting parts (120).). Each of the two hooked ends of middle connecting bar (132) are put into a hole in connecting part (120). The middle connecting bars (132) provide support for the overall frame structure. This is shown in FIG. 32*d*.

Figure 32E:
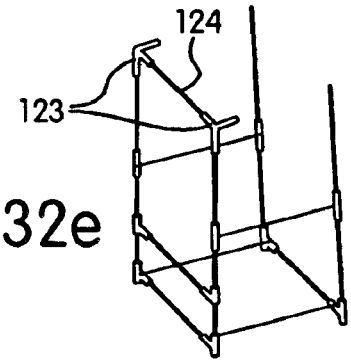

5.) A plastic connecting part (123) is already attached to either side of the top back horizontal pole (124). One of the plastic connecting parts (123) is attached to each of the front top vertical poles (122) in the back of the frame (105). This is shown in FIG. 32*e*.

Figure 32F:
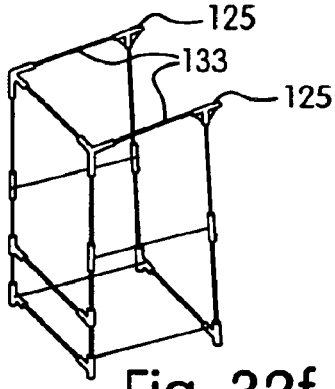

6.) A plastic connecting part (125) is already attached to one end of each of the two top back horizontal bars (133). Each of the two top back horizontal bars (133) is attached to a connecting part (123) at its other end. Each plastic connecting part (125) (to which one end of each of the two top back horizontal bars (133) is attached) is also attached to the front top vertical poles (122) in the front of the frame (105). This is shown in FIG. 32*f*.

Figure 32G:
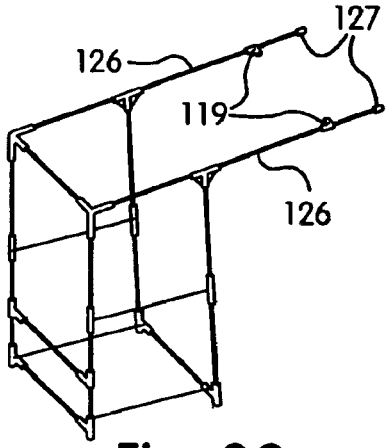

7.) A top front horizontal bar (126) is attached to the remaining orifice in each of the two plastic connecting parts (125). Each of the two top front horizontal bars has plastic connecting part (119) already attached to it. A plastic end knob (127) may be present on the end of each of the top front horizontal bars (126). This is shown in FIG. 32*g*.

Figure 32H:
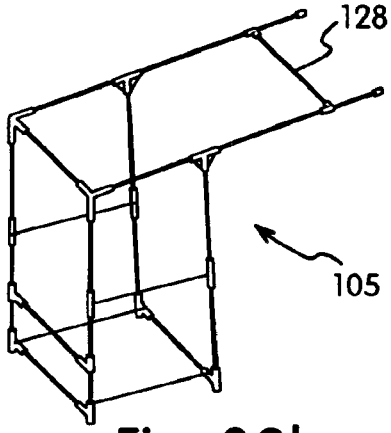

8.) A top front horizontal pole (128) is attached at each of its two ends to one of the two plastic connecting parts (119). This is shown in FIG. 32*h*.

Some of the plastic connecting parts are attached to the poles and bars by means of screws which run through both the plastic connecting part and the pole. These attachments are intended upon being permanent, and may be done by the manufacturer, rather than the player. For example, plastic connecting parts (115) are attached to the front and back bottom horizontal pipes by means of screws. Both plastic connecting parts (120) and plastic connecting parts (119) are attached to the back bottom vertical poles (118) by means of screws. Plastic connecting parts (120) also are attached to the front bottom vertical poles (121) by means of screws. A plastic connecting parts (123) is attached to the top back horizontal pole (124) by means of screws. A plastic connecting parts (125) is attached to one end of each of the top back horizontal bars (133) by means of screws. And, both a plastic end knob (127) and a plastic connecting part (119) is attached to each of the top front horizontal bars (126) by means of screws.

In contrast, some of the plastic connecting parts are attached to the bars and poles manually by the player/user of the Golf Short Game Training, Practice and Contest Game Kit. These attachments are not permanent, so that the frame can be easily and quickly put together and taken apart by the player/user. For example, the player/user must put each of the two hooked ends of bottom connecting bar (116) into a hole in connecting part (115), connecting part (115) being (permanently) attached to a front and back horizontal pipe (114).

With regard to the second embodiment of the Golf Short Game Training, Practice and Contest Game Kit, as is shown in FIG. 36, for example, two bottom pipes (230) are each attached at both of their ends to plastic connecting parts (218). Each of two rods (220) connects plastic connecting parts (218) attached to both of the bottom pipes (230), forming a square shape as is shown in, for example, FIG. 36. The ends of each of the two rods are L-shaped and fit into holes (219) in plastic connecting parts (218). Each of the plastic connecting parts (218) attached to the bottom pipe (230) in the front of the frame (200) is also attached to a front bottom vertical pole (234). The other end of each of the front bottom vertical poles (234) is attached to plastic connecting part (216). The other end of plastic connecting part (216) is attached to a front top vertical pole (233).

Each of the plastic connecting parts (218) attached to the bottom pipe (230) in the back of the frame (200) is also attached to a back bottom vertical pole (236). The other end of each of the back bottom vertical poles (236) is attached to plastic connecting part (216). Plastic connecting part (214) is attached to each of the back bottom vertical poles (236) between plastic connecting part (216) and plastic connecting part (218). A back middle horizontal pipe (232) is attached at each of its ends to one of the plastic connecting parts (214). The other end of plastic connecting part (216) is attached to a back top vertical pole (235). A rod (220) is attached at each of its ends to plastic connecting part (217) on each of the sides of the frame (200). The ends of each of the two rods are L-shaped and fit into holes (217) in plastic connecting parts (216).

Attached to the end of each of the back top vertical poles (235) which is not attached to plastic connecting part (216) is plastic connecting part (215).). Running between and attached to both plastic connecting parts (215) is top back horizontal pipe (228). Attached to the end of each of the front top vertical poles (233) which is not attached to plastic connecting part (216) is plastic connecting part (214). A top back horizontal bar (242) is attached to and runs between both of these plastic connecting parts, that is, between plastic connecting part (215) and plastic connecting part (214). Extending from both plastic connecting parts (214) on the side of these connecting parts which is opposite from the top back horizontal bars (242) are top middle horizontal bars (243). On the other end of the top middle horizontal bars (243) are plastic connecting parts (229). Running between and attached to both plastic connecting parts (229) is top middle horizontal pipe (231). Extending from both plastic connecting parts (229) on the side of these connecting parts which is opposite from the top middle horizontal bars (243) are top front horizontal bars (244). A front top sleeve (221) holding the netting (201) in place on the frame (200) may be attached to the other ends of the top front horizontal bars (244).

The enclosure on the frame (105, 200) preferably is composed of netting (104, 201), but can be composed of any other material, with or without holes in it, provided that, preferably, such material is foldable or flexible enough so that it can be folded up and placed in the carrying bag (101). The enclosure can be composed of any suitable natural or synthetic material, such as, cotton (for example, coated with a water-resistant or abrasion-resistant material) or a synthetic plastic.

The (entire) netting (104 and 201) shown in FIGS. 1, 3, 5, 6, 7, 9, 33, 34, 35, 37 and 38 includes at least one back portion (153, 223), at least two side portions (155, 225), at least one top portion (154, 224), at least one bottom floor (156, 240), and an inclined floor net (103, 202).

The netting (104 and 201) is hung on and attached to the frame (105) with the clips (129, 237) which are attached to the netting. Also, the netting may include two tubular portions (137). Each of the two top front horizontal bars (126) may fit into one of the tubular portions (137), holding the netting (104) in place on the frame (105). Also, the netting may include a front top sleeve (221) into which two top front horizontal bars (244) may be positioned, holding the netting (201) in place on the frame (200).

The exterior surface of the plastic connecting parts to which clips (129) are attached have flat surfaces, as well as curved surfaces, so that the clips attach securely to these surfaces. For example, plastic connecting part (123) has both flat and curved surfaces on it, and clip (129) attaches securely onto this surface.

On the so-called first embodiment, a zipper (134) is present, running vertically from the top to the bottom of the right side portion (155) of the netting (right side as you face the front of the (entire) frame (105)). A person can unzip the zipper in the netting and easily reach in behind the target panel (135) to retrieve one or more golf balls in one or more of the mesh pouches (136) which may be hanging behind the target panel (135).

On the so-called second embodiment, a zipper (213) is also present, running first horizontally from the front to the back of the right side portion (155) of the netting, and, then, vertically, from the top to the bottom of the netting. Here too, a person can unzip the zipper in the netting and easily reach in behind the holed target panel (205) to retrieve one or more golf balls in one or more of the mesh pouches (206) which may be hanging behind the holed target panel (205).

Figure 7:
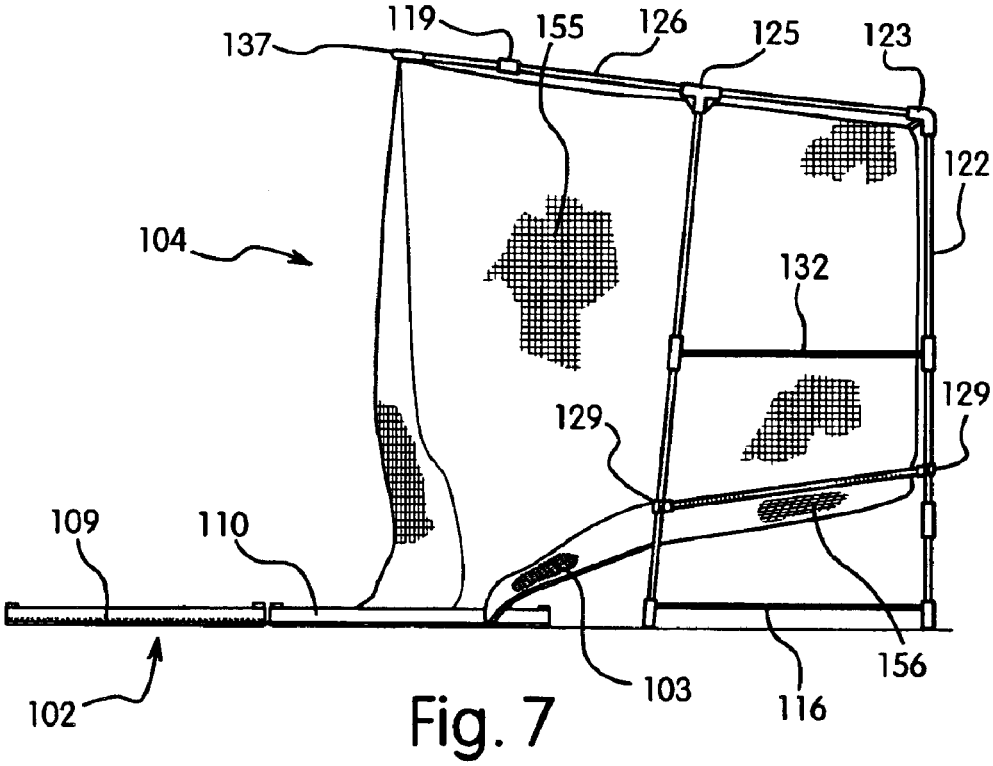
FIG. 7 is a side view of the frame, netting and chipping green including the inclined floor net (103) (fist embodiment)
Figure 8:
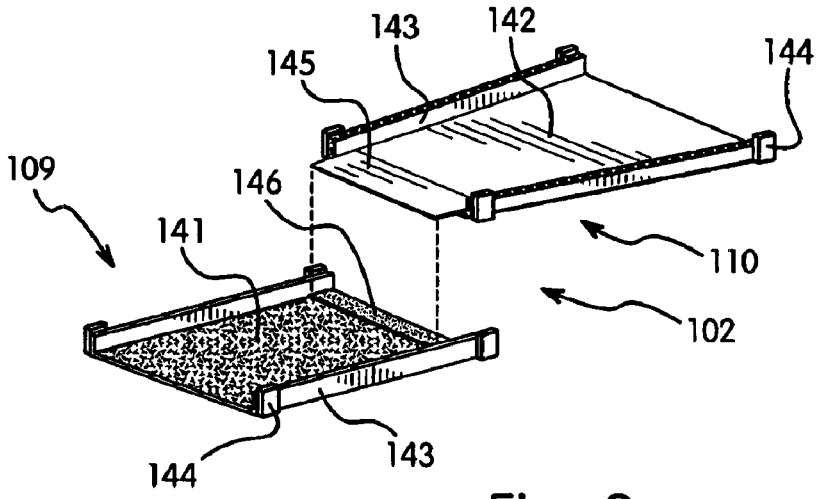
FIG. 8 is a side perspective view of the chipping green including its first portion and its second portion and how these two portions are secured to one another.
Figure 9:
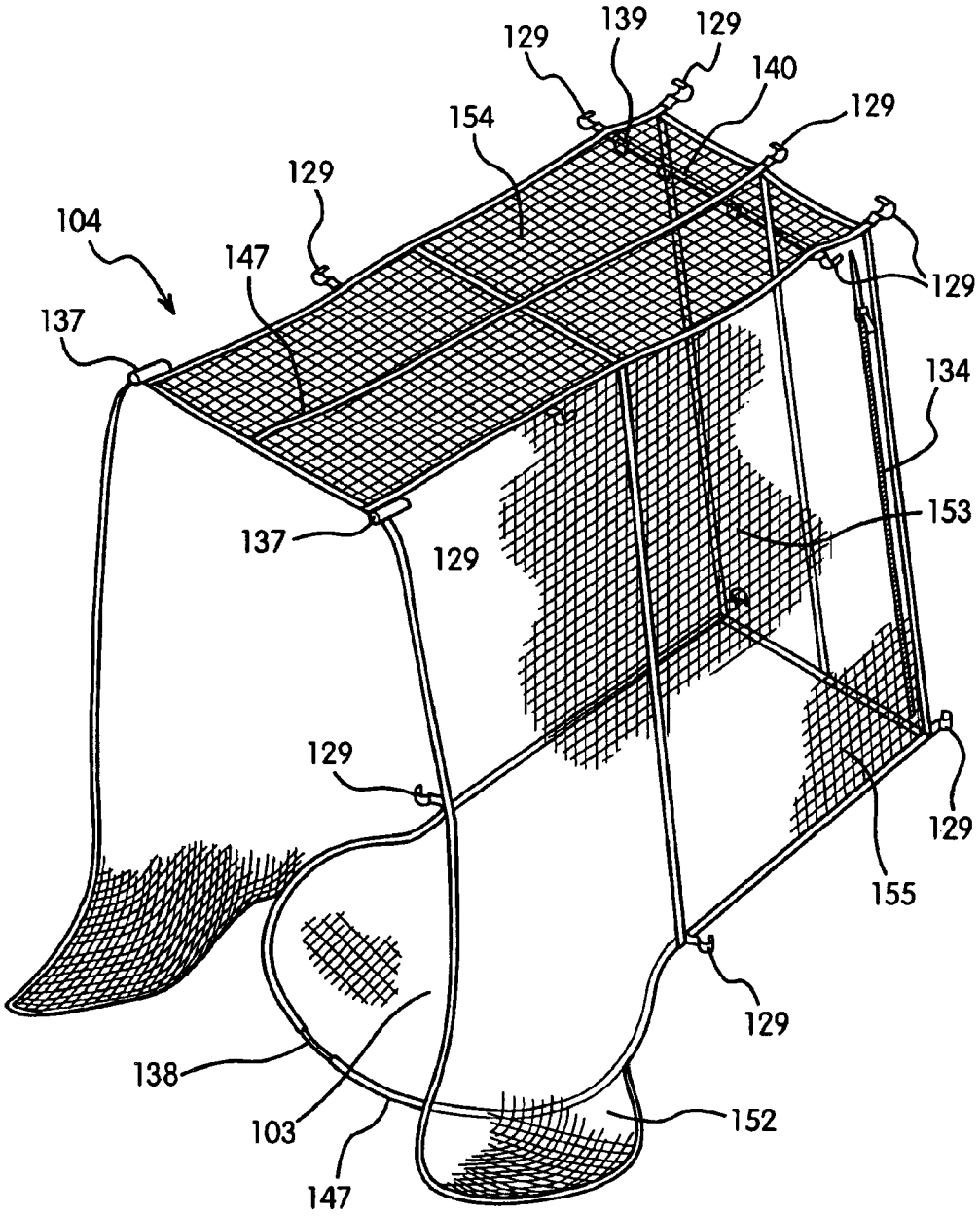
FIG. 9 is a side perspective, elevated view of the netting (first embodiment)

As is shown clearly in, for example, FIG. 7, the inclined floor net (103, 202) extends from the bottom floor (156, 240) of the netting towards and beyond the front bottom vertical poles (121, 234) of the frame. A wire (138, 226) is sewn (hemmed) inside the area between the material strip (147, 227) which is secured to the outer perimeter of the inclined floor net (103, 202) and the underlying netting. It should be noted that, as is shown clearly in, for example, FIGS. 9 and 38, a material strip (147, 227) without a wire running through it is secured to the outer edges of all of the netting, and also runs through the middle of the top portion (154, 224) of the netting in a cross-shaped pattern. The wire (138, 226) which runs through the material strip (147, 227) which is secured to the outer perimeter of the inclined floor net (103, 202) may be bent so that, when a player hits a ball towards one of the target panels (204, 205), if the ball does not become lodged in a mesh pouch (136, 206) behind the holed target panel (149, 205), it will fall to the bottom floor (156, 240) of the netting, roll forward to the inclined floor net (103, 202) and, then, because of the angle of the inclined floor net, roll out onto the chipping green (102), for example, and back to the player. The wire (138, 226) can also be bent so that a pocket is formed in the inclined floor net (103, 202) into which one or more balls will roll from the bottom floor (156, 240) of the netting and inclined floor net (103, 202) and be caught/gathered. This latter feature may be particularly useful when a player is using multiple golf balls at one time.

Figure 10:
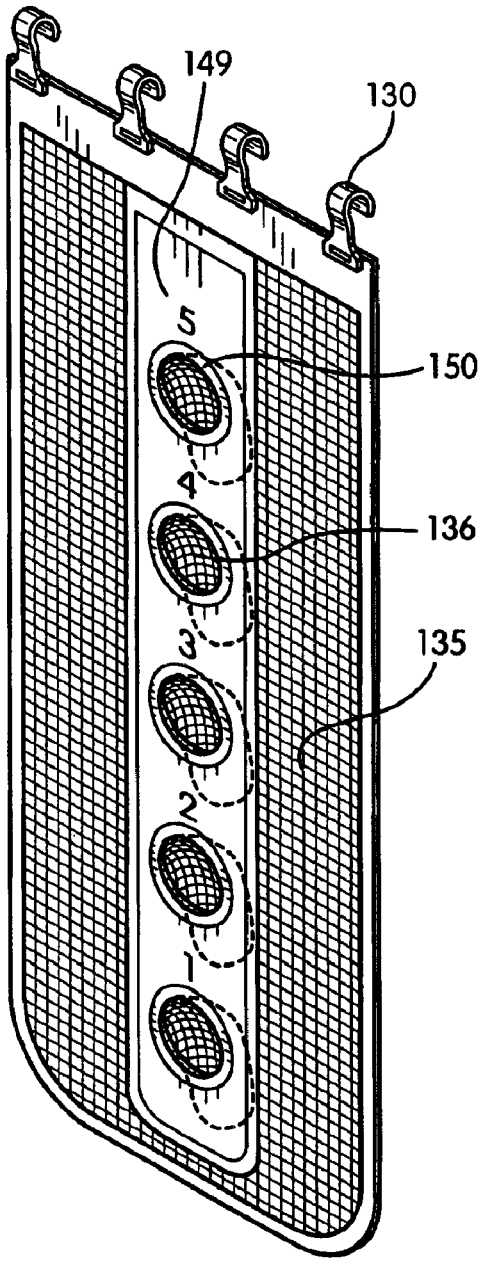
FIG. 10 is a perspective view of the target back panel with attached holed target panel (first embodiment)
Figure 11:
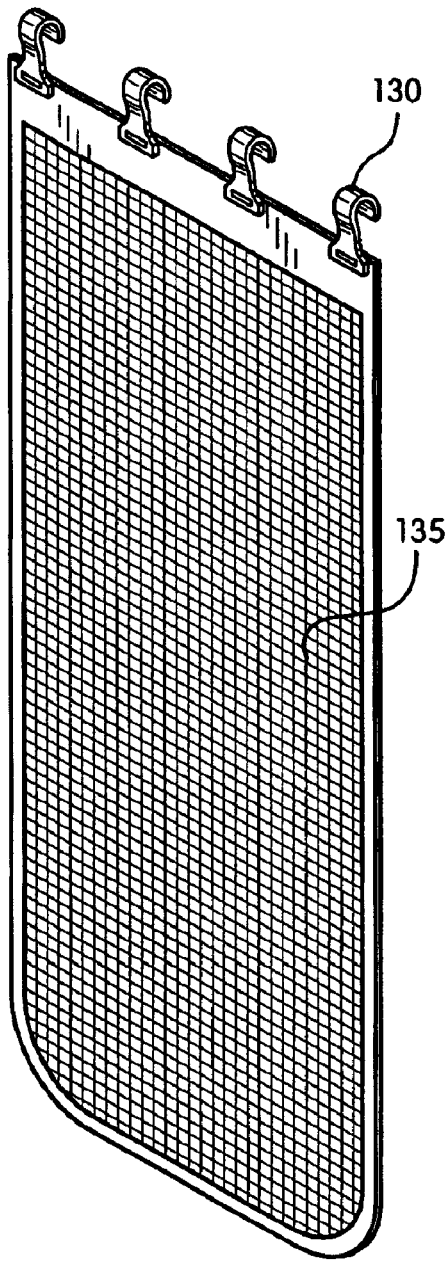
FIG. 11 is a perspective view of the target back panel (first embodiment)
Figure 12:
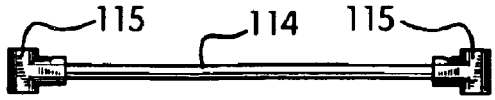
FIG. 12 is a view of a front and back bottom horizontal pipe with attached plastic connecting parts (first embodiment)
Figure 13:
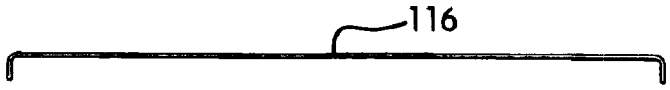
FIG. 13 is a view of a bottom connecting bar (first embodiment)
Figure 14:
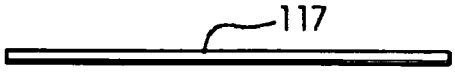
FIG. 14 is a view of a back middle horizontal pole (first embodiment)
Figure 15:
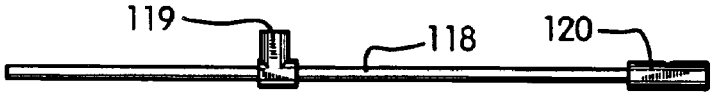
FIG. 15 is a view of a back bottom vertical pole with attached plastic connecting parts (first embodiment)
Figure 16:
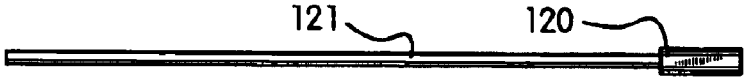
FIG. 16 is a view of a front bottom vertical pole with attached plastic connecting part (first embodiment)
Figure 17:
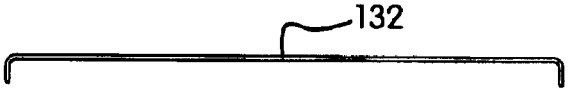
FIG. 17 is a view of a middle connecting bar (first embodiment)
Figure 18:
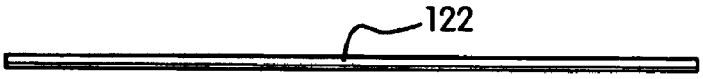
FIG. 18 is a view of a front top vertical pole (first embodiment)
Figure 19:
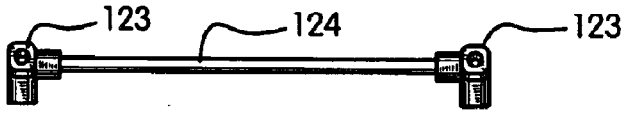
FIG. 19 is a view of a top back horizontal pole with attached plastic connecting parts (first embodiment)
Figure 20:
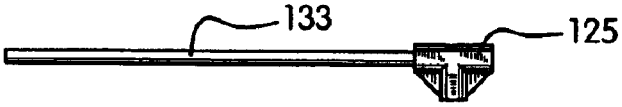
FIG. 20 is a view of a top back horizontal bar with attached plastic connecting part (first embodiment)
Figure 21:
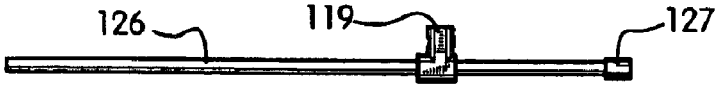
FIG. 21 is a view of a top front horizontal bar with attached plastic connecting parts (first embodiment)
Figure 22:
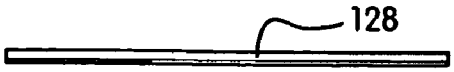
FIG. 22 is a view of a top front horizontal pole (first embodiment)
Figure 23:
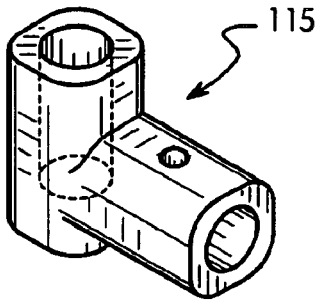
FIG. 23 is a view of a plastic connecting part (first embodiment)
Figure 24:
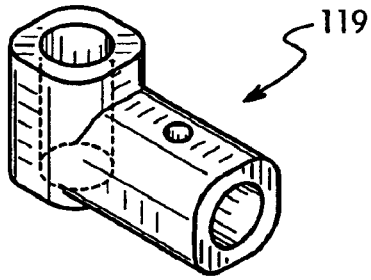
FIG. 24 is a view of a plastic connecting part (first embodiment)
Figure 25:
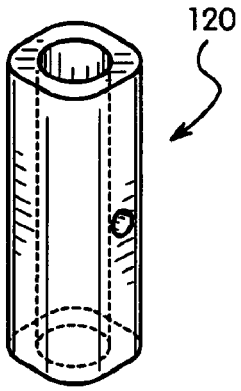
FIG. 25 is a view of a plastic connecting part (first embodiment)
Figure 26:
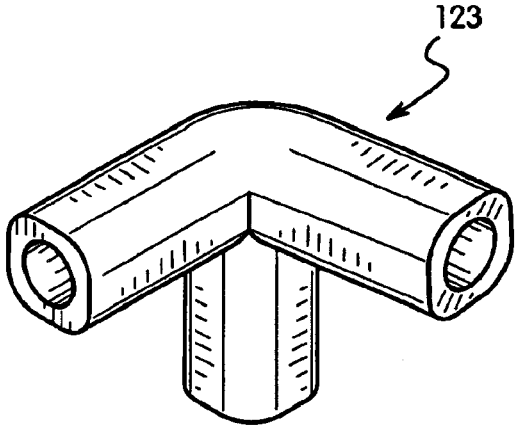
FIG. 26 is a view of a plastic connecting part (first embodiment)
Figure 27:
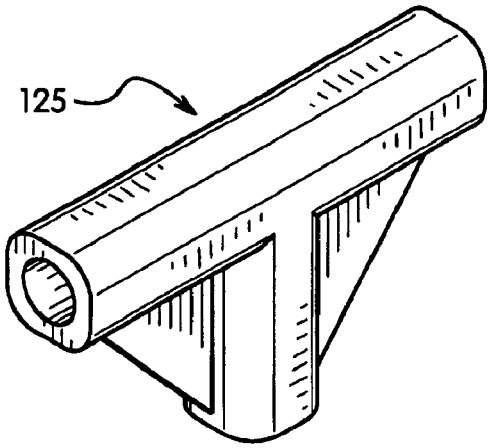
FIG. 27 is a view of a plastic connecting part (first embodiment)
Figure 28:
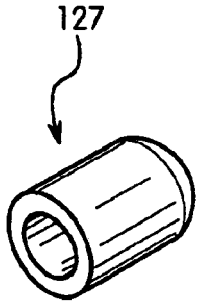
FIG. 28 is a view of a plastic end knob (first embodiment)
Figure 29:
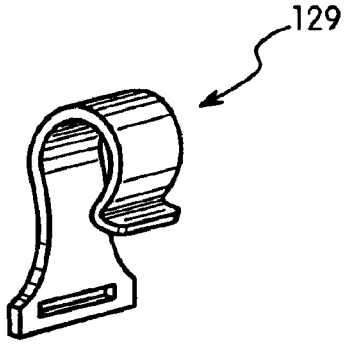
FIG. 29 is a view of a clip (first embodiment)
Figure 30:
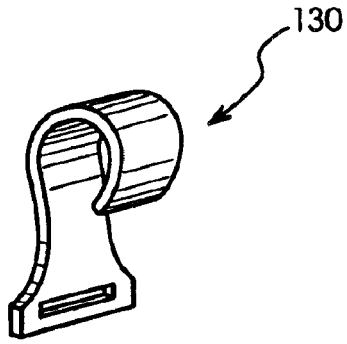
FIG. 30 is a view of a hook (first embodiment)
Figure 31:
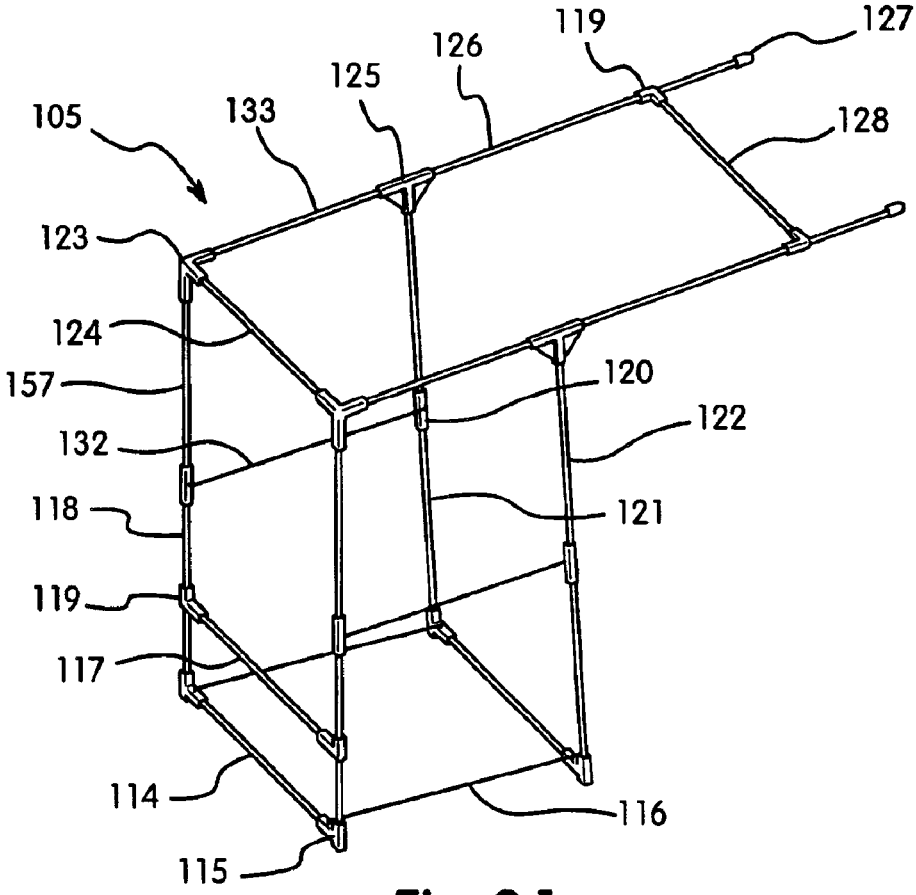
FIG. 31 is a side perspective, elevated view of the entire assembled frame (first embodiment)

As is clearly shown in FIGS. 1, 10 and 11, for example, in the first embodiment of the Golf Short Game Training, Practice and Contest Game Kit, a target back panel (135) can be attached by four hooks (130) to four elastic rings (139) which hang from a band (140) that runs across and is secured to the top portion (154) of the netting. A plain target panel (148), a holed target panel (149) or both may be attached to the target back panel (135). The target back panel (135) may be rectangular in shape, for example, and may be slightly less tall and wide than the back portion (153) of the netting.

The plain target panel (148) of the first embodiment includes at least one solid colored target (151) which is printed or sewn onto a flap of material which is secured onto the target back panel (135). The plain target panel (148) may include, for example, five solid colored targets (151), that is, it may include, from top to bottom, a red circular target, a green circular target, an orange circular target, a blue circular target and a yellow circular target. The colored circular targets may be printed onto the surface of the plain target panel (148), or they may be sewn onto the surface of the plain target panel, for example. The plain target panel (148) may be rectangular in shape, and may hang down from the center of the target back panel (135). The plain target panel (148) may be slightly less tall and wide than the back portion (153) of the netting. When a player hits a ball against one of the plain targets (151), thereafter it will fall to the bottom floor (156) of the netting, roll forward to the inclined floor net (103) and, then, roll out onto the chipping green (102), for example, and back to the player, unless a pocket has been formed by the player in the inclined floor net (103) into which one or more balls will be caught/gathered.

The holed target panel (149) of the first embodiment includes at least one holed target secured onto a flap of material which is secured onto the target back panel (135). The holed target panel (149) may include, for example, five numbered targets (where a number between one and five is printed above or below each holed target). Each holed target may include a hole behind which is a mesh pouch (136). A solid colored circle (150) may be printed onto the surface of the holed target panel (149) around each target hole, or it may be sewn onto the surface of the holed target panel around each target hole, for example. The holed target panel (149) may be rectangular in shape, and may hang down from the center of the target back panel (135). The holed target panel (149) may be slightly less tall and wide than the back portion (153) of the netting. When a player hits a ball through one of the target holes, thereafter it will be caught in the attached mesh pouch (136). Then, the player can unzip the zipper running vertically from the top to the bottom of the right side portion (155) of the netting adjacent to the back top vertical pole (157), reach in and release the ball from the mesh pouch. Thereafter, the ball will fall to the bottom floor (156) of the netting, roll forward to the inclined floor net (103) and, then, roll out onto the chipping green (102), for example, and back to the player, unless a pocket has been formed by the player in the inclined floor net (103) into which one or more balls will be caught/gathered.

As is clearly shown in FIGS. 34 and 39 to 41, for example, in the second embodiment of the Golf Short Game Training, Practice and Contest Game Kit, a safety net (203) can be attached by four clips (207) to a bar (238) which, in turn, is attached to the top back horizontal bar (242) of the frame by means of at least two clips (239). A panel including at least one plain individual mark (210), a panel including at least one holed individual mark (211) or both may be attached to the safety net (203) by means of, for example, Velcro™. That is, for example, a strip of Velcro™ loops (208) may be present at the top of the safety net (203), and a strip of Velcro™ hooks (209) may be present at the top of a panel including at least one plain individual mark (210), a panel including at least one holed individual mark (211), or both. The safety net (203) may be rectangular in shape, for example, and may be slightly less tall and wide than the back portion (223) of the netting.

The panel including at least one plain individual mark (210) of the second embodiment has at least one solid colored target (210) which is printed or sewn onto a flap of material which, in turn, is secured onto the safety net (203). This panel may include, for example, five solid colored targets (210). The colored circular targets (210) may be printed onto the surface of the panel attached to the safety net, or they may be sewn onto the surface of the plain target panel, for example. The panel including at least one plain individual mark (210) may be rectangular in shape, and may hang down from the center of the safety net (203). This panel may be slightly less tall and wide than the back portion (223) of the netting. When a player hits a ball against one of the solid colored targets (210), thereafter it will fall to the bottom floor (240) of the netting, roll forward to the inclined floor net (202) and, then, roll out onto the chipping green (102), for example, and back to the player, unless a pocket has been formed in the inclined floor net (202) into which one or more balls will be caught/gathered.

The panel including at least one holed individual mark (211) of the second embodiment has at least one holed individual mark (211) secured onto a flap of material which, in turn, is secured onto the safety net (203). This panel may include, for example, five holed individual marks/targets. Each holed individual mark/target may include a hole behind which is a mesh pouch (212). A solid colored circle may be printed onto the surface of this panel around each target hole, or it may be sewn onto the surface of this panel around each target hole, for example. This panel may include, for example, five numbered targets (where a number between one and five is printed above or below each holed target). This panel may be rectangular in shape, and may hang down from the center of the safety net (203). This panel may be slightly less tall and wide than the back portion (223) of the netting. When a player hits a ball through one of the target holes, thereafter it will be caught in the attached mesh pouch (212). Then, the player can unzip the zipper (213) running horizontally and, then, vertically from the top to the bottom of the right side portion (225) of the netting, reach in and release the ball from the mesh pouch. Thereafter, the ball will fall to the bottom floor (240) of the netting, roll forward to the inclined floor net (202) and, then, roll out onto the chipping green (102), for example, and back to the player, unless a pocket has been formed in the inclined floor net (202) into which one or more balls will be caught/gathered.

Alternatively, as is shown in FIG. 33, a safety net (203) to which a plain target panel (204) is attached and a safety net (203) to which a holed target panel (205) is attached may hang between the top back horizontal bars (242), one in front of the other. The plain target panel (204) and safety net (203), and the holed target panel (205) and safety net are each secured to a separate bar (238) which, in turn, is attached to the top back horizontal bars (242) of the frame by means of at least two clips (239).

Figure 51:
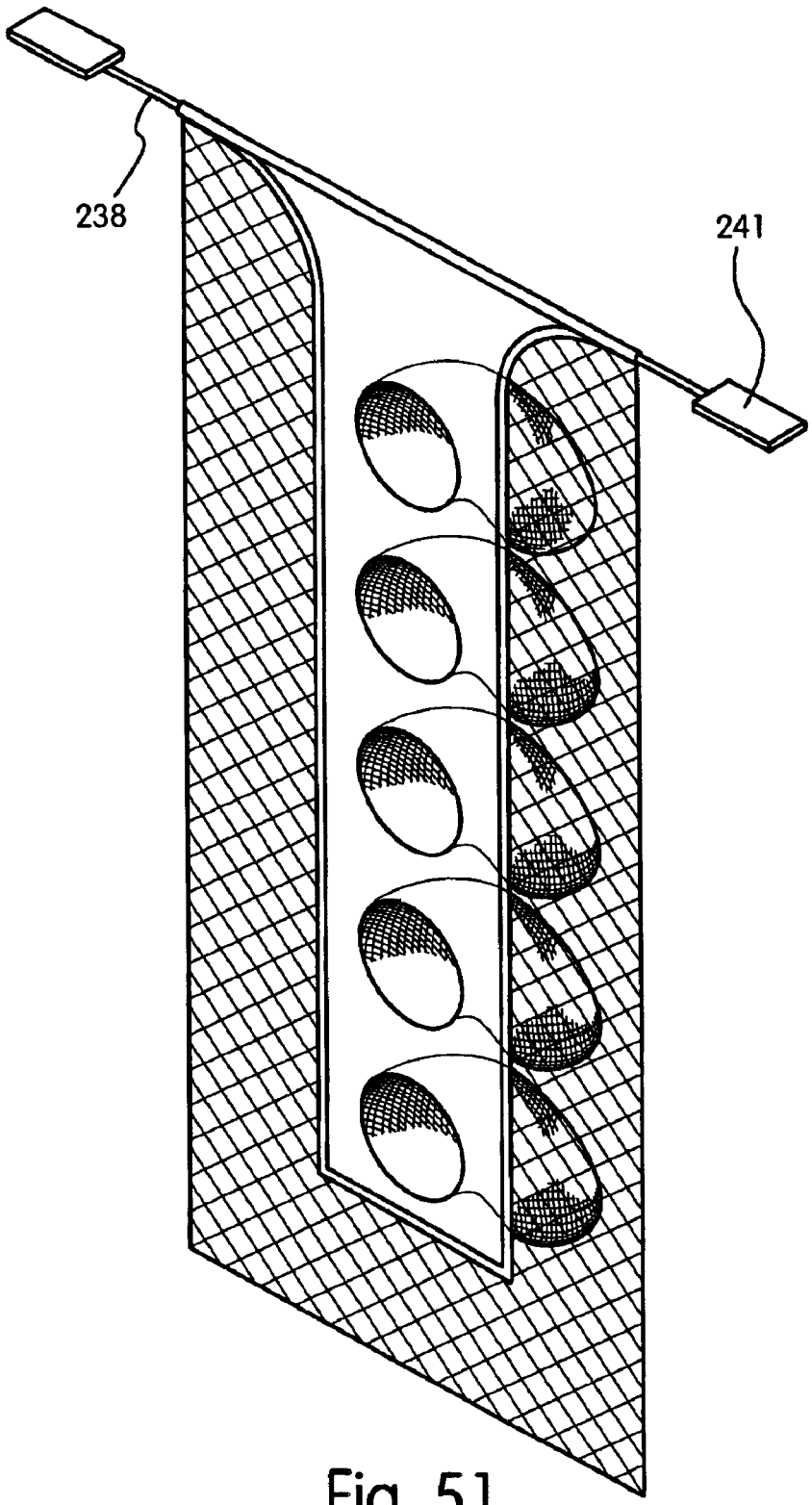
FIG. 51 is a perspective view of the safety net with attached holed target panel which, in turn, is attached to the top back horizontal bars of the frame by means of at least two flat or bendable surfaces.

Alternatively, as is shown in FIG. 51, a safety net (to which a plain target panel (204) or a holed target panel, or both is/are attached) may be attached to the top back horizontal bars (242) of the frame by means of at least two flat or bendable surfaces (241).

Figure 4:
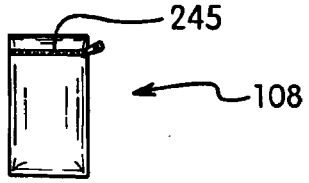
FIG. 4 is a top view of one of the bags.
Figure 5:
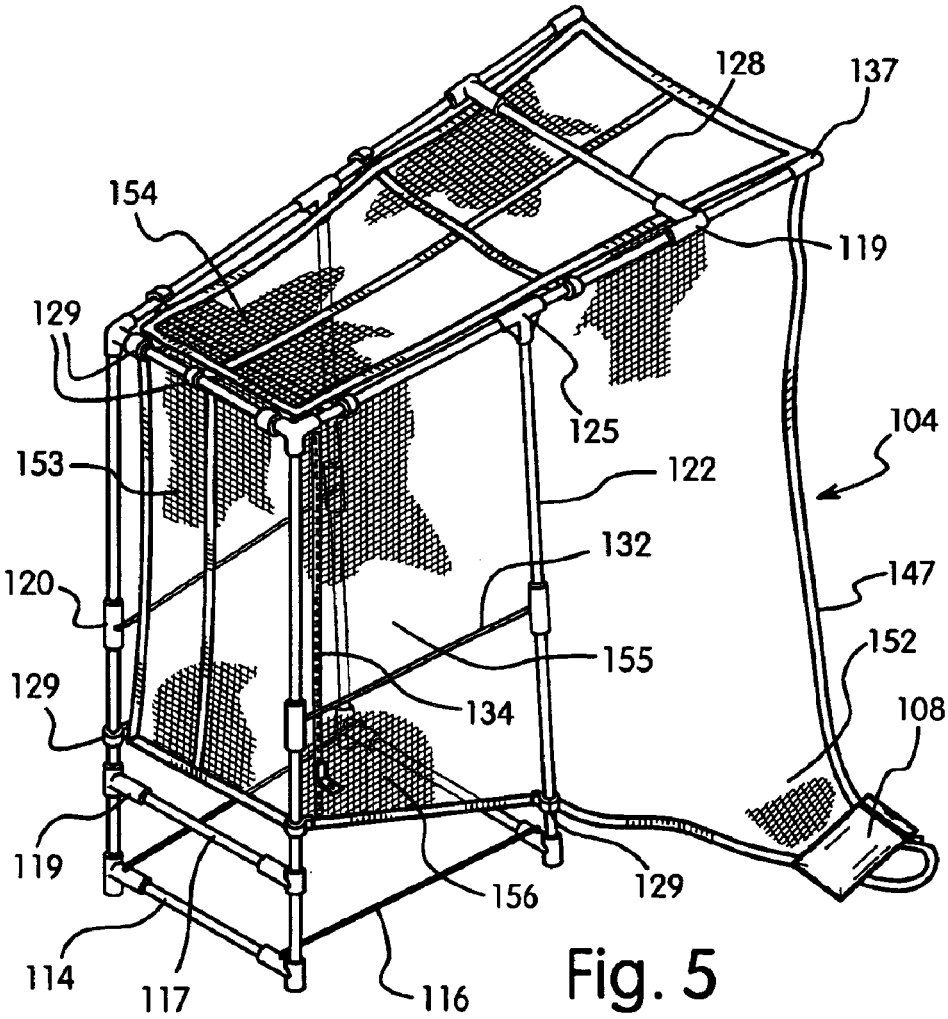
FIG. 5 is a back, side perspective, elevated view of the frame with attached netting and one of the bags laying on one of the front flaps of the netting (first embodiment)
Figure 6:
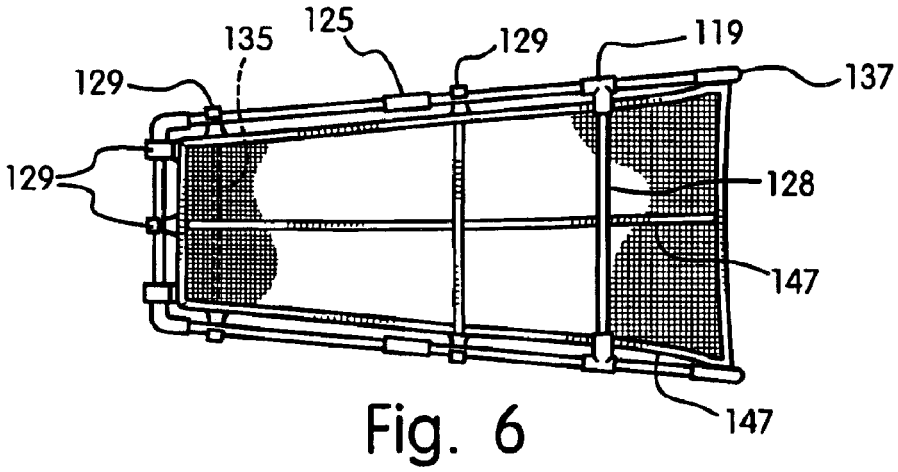
FIG. 6 is a top view of the frame with attached netting (first embodiment)

The kit includes at least two bags. As shown in FIGS. 1, 4 and 5, the bags are rectangular in shape, made of a sturdy material, and include a zipper. A heavy material, such as, for example, sand, clean kitty litter or pebbles, may be placed into each of the bags by opening the zipper (108). Then, after the zipper is closed, each of the two bags (108) may be placed onto one of the two front flaps (152, 222) of the netting to weigh it down and hold it in place. When it is desired to load the kit (100, 109 and 110) back into the carrying bag (101), for example, to carry it somewhere or for storage, the zipper of the bag can be opened and the contents of the bag can be poured out.

A chipping green (102) may be included as part of the Golf Short Game Training, Practice and Contest Game Kit. As is shown clearly in FIGS. 1, 3, 7 and 8, the chipping green (102) may be formed from two portions, a first portion (109) in which there is an upper layer of synthetic grass (141), and a second portion (110) in which there is an upper layer of non-synthetic grass material (142), which may be green in color and is at least fairly devoid of texture. The first portion of the chipping green may be rectangular in shape, with a raised plastic edge (143) running along its longer two sides and a cap (144) at each end of the raised plastic edge. The raised plastic edge (143) may be, for example, about one inch high. The second portion (110) of the chipping green may be generally rectangular in shape, with one of the two shorter sides of this portion being somewhat wider than the other. A raised plastic edge (143) may run along its longer two sides, and a cap (144) may be present at each end of the raised plastic edge. The raised plastic edge (143) may be, for example, about one inch high. The two longer sides of the second portion (110) of the chipping green may be 90 cm in length, and the two shorter sides may be 30.5 cm and 39 cm in length, for example. The shorter (30.5 cm) of the two shorter sides attaches to one of the shorter sides of the first portion (109) of the chipping green, for example. The means of attachment here may be Velcro™. A Velcro™ strip (loops) (146) may be attached to one of the shorter ends of the first portion (109) of the chipping green. The material surface (142) in the second portion of the chipping green may extend beyond the raised plastic edges (143) of the chipping green. On the bottom of this extending portion of the material green may be a strip of Velcro™ (hooks) (145) which attaches to the Velcro™ strip (146) on the first portion of the chipping green.

The wire (138, 226) which runs through the material strip (147, 227) which is secured to the outer perimeter of the inclined floor net (103, 202) may be bent so that, when a player hits a ball towards one of the target panels (204, 205) (if the ball does not become lodged in a mesh pouch (136, 206) behind the holed target panel (149, 205) or if the player releases the ball from the mesh pouch), it will fall to the bottom floor (156, 240) of the netting, roll forward to the inclined floor net (103, 202) and, then, because of the angle of the inclined floor net, roll out onto the second portion (110) of the chipping green and, then, onto the first portion (109) back to the player.

The putting green (106), which is rectangular in shape, is 9 feet 5 inches long and 13 inches wide. At one end of the putting green (106) is a raised mound (113). In the center of the raised mound is a white plastic cup (112) to catch a golf ball.

The kit can contain one or more golf clubs, such as, a wedge, a chipping club and/or a putter. Golf balls can also be included.

A score card (111), on which the directions for how to play the so-called Jason Golf Game may be detailed (see FIG. 47), may be included as part of the Golf Short Game Training, Practice and Contest Game Kit.

All of the contents of the Golf Short Game Training, Practice and Contest Game Kit, including the chipping green (102), the putting green (106), and the rectangular green (107), fit within the carrying bag (101). Thus, it is easy to transport the entire kit.

What is claimed is:

1. A golf short game training, practice and contest game assemblage, which comprises:

(a) a frame having a front portion, a top portion, a bottom portion and at least two side portions;

(b) a netting having a top portion, a back portion, two side portions, a bottom floor and an inclined chute-shaped floor net, the inclined chute-shaped floor net having a front side with a front outer perimeter and a back side, the back side of the inclined chute-shaped floor net being affixed to or integral with the bottom floor of the netting, and the front side of the inclined chute-shaped floor net being lower than the back portion of the netting, the netting being supported by the frame;

(c) a target suspended from the top portion of the netting; and (d) a wire which runs through a material strip which is secured to the outer perimeter of the inclined floor net so that the front side of the inclined chute-shaped floor net may be bent either to allow a golf ball to roll forward from the bottom floor of the netting to and beyond the outer perimeter of the inclined chute-shaped floor net or to form a pocket in the front side of the inclined chute-shaped floor net in which at least one golf ball may be gathered.

2. The golf short game training practice and contest game assemblage as claimed in claim 1, wherein the frame is assembled from steel pipes and plastic connecting parts, and the netting is attached to the frame by means of at least one clip.

3. The golf short game training, practice and contest game assemblage as claimed in claim 1, further comprising a chipping green positioned beneath the outer perimeter of the inclined chute-shaped floor so that a golf ball can roll forward from the bottom floor of the netting to and beyond the outer perimeter of the inclined chute-shaped floor net onto the chipping green and back to a player.

4. The golf short game training, practice and contest game assemblage as claimed in claim 3, further comprising a putting green, and at least one rectangular green.

5. The golf short game training, practice and contest game assemblage as claimed in claim 1, wherein the two side portions of the netting include front flaps which flare outward.

6. The golf short game training, practice and contest game assemblage as claimed in claim 5, further comprising at least two bags, the bags each having a zipper which can be opened so that the bags can be filled with a heavy material, each of the bags being put on one of the front flaps of the netting.

7. The golf short game training, practice and contest game assemblage as claimed in claim 1, wherein the target suspended from the top portion of the netting has at least one hole therein that is larger than a golf ball.

8. The golf short game training, practice and contest game assemblage as claimed in claim 1, wherein the target suspended from the top portion of the netting has at least one solid colored circular target that is larger than a golf ball.

9. The golf short game training, practice and contest game assemblage as claimed in claim 1, wherein the target panel suspended from the top portion of the netting both has at least one hole therein that is larger than a golf ball and has at least one solid colored circular target that is larger than a golf ball.

10. The golf short game training, practice and contest game assemblage as claimed in claim 7, further comprising a mesh pouch attached to and hanging behind each of the at least one holes in the target, and a zipper attached to the side portion of the netting through which a player can reach the at least one mesh pouch.

11. The golf short game training, practice and contest game assemblage as claimed in claim 7, further comprising at least one target back panel, the at least one target back panel being secured to top, back side bars with at least two clips, and wherein the target suspended from the top portion of the netting is attached to the target back panel.

12. The golf short game training, practice and contest game assemblage as claimed in claim 7, further comprising at least one target back panel, the at least one target back panel being secured to at least two elastic rings, the at least two elastic rings being attached to a band which runs across and is attached to the top portion of the netting, the target which has at least one hole therein that is larger than a golf ball being attached to the at least one target back panel.

13. The golf short game training, practice and contest game assemblage as claimed in claim 8, further comprising at least one target back panel, the at least one target back panel being secured to at least two elastic rings, the at least two elastic rings being attached to a band which runs across and is attached to the top portion of the netting, the target panel having at least one solid colored circular target that is larger than a golf ball being attached to the at least one target back panel.

14. The golf short game training, practice and contest game assemblage as claimed in claim 9, further comprising at least one target back panel, the at least one target back panel being secured to at least two elastic rings, the at least two elastic rings being attached to a band which runs across and is attached to the top portion of the netting, the target having at least one solid colored circular target that is larger than a golf ball being attached to the at least one target back panel, and the target which has at least one hole therein that is larger than a golf ball being attached to the at least one target back panel.

15. The golf short game training, practice and contest game assemblage as claimed in claim 9, wherein the target back panel with the target panel attached to it which has at least one hole therein that is larger than a golf ball and the target back panel with the target panel attached to it which has at least one target having at least one solid colored circular target that is larger than a golf ball are positioned one in front of the other.

16. The golf short game training, practice and contest game assemblage as claimed in claim 11, wherein a strip of Velcro™ loops is attached to the at least one target back panel and a strip of Velcro™ hooks is attached to the target panel which has at least one hole therein that is larger than a golf ball.

17. The golf short game training, practice and contest game assemblage as claimed in claim 11, wherein a strip of Velcro™ loops is attached to the at least one target back panel and a strip of Velcro™ hooks is attached to the target panel which has at least one solid colored circular target that is larger than a golf ball.

18. The golf short game training, practice and contest game assemblage as claimed in claim 3, further comprising a carrying bag.

19. A portable kit for assembling a golf training, practice and contest game assemblage, comprising:

(a) a carrying container; and (b) parts for assembling the golf training, practice and contest game assemblage, said parts fitting within said carrying container, said parts including:

(i) individual elongated poles, bars and connecting parts that form framework of the golf training, practice and contest game assemblage;

(ii) netting forming a three dimensional entity with an open front side, having a chute extending from bottom edge of the open front side, and having two vertical side wings, each vertical side wing extending from a vertical side of the open front, the netting being supported by the framework;

(iii) a target, having at least one aperture therein, the target being hung from, or being capable of being hung from, top side of the netting or the framework, and located or to be located inside of the netting entity; and (iv) a wire which runs through a material strip which is secured to the outer perimeter of the inclined floor net so that the front side of the inclined chute-shaped floor net may be bent either to allow a golf ball to roll forward from the bottom floor of the netting to and beyond the outer perimeter of the inclined chute-shaped floor net or to form a pocket in the front side of the inclined chute-shaped floor net in which at least one golf ball may be gathered.

20. A golf short game training, practice and contest game assemblage, which comprises:

(a) a frame having a front portion, a top portion, a bottom portion and at least two side portions;

(b) a netting having a top portion, a back portion, two side portions, a bottom floor and an inclined chute-shaped floor net, the inclined chute-shaped floor net having a front side with a front outer perimeter and a back side, the back side of the inclined chute-shaped floor net being affixed to or integral with the bottom floor of the netting, and the front side of the inclined chute-shaped floor net being lower than the back portion of the netting, the netting being supported by the frame;

(c) a target suspended from the top portion of the netting wherein the target suspended from the top portion of the netting has at least one hole therein that is larger than a golf ball with a numerical value present next to the at least one hole representing a score value;

(d) a wire which runs through a material strip which is secured to the outer perimeter of the inclined floor net so that the front side of the inclined chute-shaped floor net may be bent either to allow a golf ball to roll forward from the bottom floor of the netting to and beyond the outer perimeter of the inclined chute-shaped floor net or to form a pocket in the front side of the inclined chute-shaped floor net in which at least one golf ball may be gathered; and (e) a mesh pouch attached to and hanging behind each of the at least one holes in the target, and a zipper attached to the side portion of the netting through which a player can reach the at least one mesh pouch.

* * * * *